US007446464B2

(12) United States Patent
Oh

(10) Patent No.: US 7,446,464 B2
(45) Date of Patent: Nov. 4, 2008

(54) FIELD EMISSION DISPLAY HAVING AN IMPROVED EMITTER STRUCTURE

(75) Inventor: Tae-Sik Oh, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 524 days.

(21) Appl. No.: 10/921,855

(22) Filed: Aug. 20, 2004

(65) Prior Publication Data

US 2005/0116612 A1 Jun. 2, 2005

(30) Foreign Application Priority Data

Nov. 27, 2003 (KR) ..... 10-2003-0084963
May 19, 2004 (KR) ..... 10-2004-0035534

(51) Int. Cl.
*H01J 1/62* (2006.01)
*H01J 63/04* (2006.01)

(52) U.S. Cl. ..... 313/495; 313/497; 313/496

(58) Field of Classification Search ..... 313/495–497
See application file for complete search history.

(56) References Cited

U.S. PATENT DOCUMENTS 5,552,659 A 9/1996 Macaulay et al.
5,798,604 A * 8/1998 Duboc et al. ..... 313/495
5,932,962 A * 8/1999 Nakatani et al. ..... 313/495
6,563,260 B1 * 5/2003 Yamamoto et al. ..... 313/495
2003/0184214 A1 10/2003 Lee et al.
2003/0184357 A1 10/2003 Dijon et al.

FOREIGN PATENT DOCUMENTS

EP 1 089 310 A 4/2001
EP 1 313 122 A1 5/2003

OTHER PUBLICATIONS

European Office Action of the European Patent Application No. 04254524.4—2208 PCT /, mailed on Aug. 16, 2005.

* cited by examiner

*Primary Examiner*—Nimeshkumar D. Patel
*Assistant Examiner*—Anthony T Perry
(74) *Attorney, Agent, or Firm*—Robert E. Bushnell, Esq.

(57) ABSTRACT

A field emission display (FED) is provided. The FED has an emitter structure where the emitter, a conductor and a cathode electrode are so arranged to produce a certain electric field about the emitter. The electric field about the emitter causes the electron beam emitted from the emitter to have improved focus and have less dispersion. This causes the electron beam to hit the intended pixel without exciting phosphor layers in neighboring pixels, thus improving image quality.

23 Claims, 20 Drawing Sheets

107

123
122
123
122
123
120
121
124
130
114a
113a
113
114
113
114
W3
112a
W2
111a
114
113
W1
111
110
1122
1121
115
Wc
115
1122
1121
115
111
1122
1121
112'
111
D
111
112'
111
112'

108

123
122
123
122
123
120
121
124
130
114a
113a
113
114
113
114
W3
112a
W2
111a
114
113
W1
112"
111
110
1123
112"
1123
115
Wc
115
112"
1123
115
111
112"
1123
111
D
111
111

FIELD EMISSION DISPLAY HAVING AN IMPROVED EMITTER STRUCTURE

BACKGROUND OF THE INVENTION

This application claims the priority of Korean Patent Application Nos. 2003-84963 and 2004-35534, filed on Nov. 27, 2003 and May 19, 2004, respectively, in the Korean Intellectual Property Office, the disclosures of which are incorporated herein in their entirety by reference.

1. Field of the Invention

The present invention relates to a field emission display and, more particularly, to a field emission display having an emitter structure that improves focusing characteristics of electron beams, thus improving image quality.

2. Description of the Related Art

Display devices, which account for one of the most important parts of conventional data transmitting media, have been used in personal computers and television receivers. The display devices include cathode ray tubes (CRTs), which use high-speed heat electron emission, and flat panel displays, such as a liquid crystal display (LCD), a plasma display panel (PDP), and a field emission display (FED), which have been rapidly developing in recent years.

Of those flat panel displays, an FED is a display device that enables an emitter arranged at regular intervals on a cathode electrode to emit electrons by applying a strong electric field to the emitter to radiate light by colliding the electrons with a fluorescent material coated on the surface of an anode electrode. Since the FED forms and displays images thereon by using the emitter as an electron source, the quality of the images may vary considerably depending on the material and structure of the emitters.

Early FEDs use a spindt-type metallic tip (or a micro tip) formed of molybdenum (Mo) as an emitter. In order to arrange such metallic tip-type emitter in an FED, however, an ultramicroscopic hole should be formed, and molybdenum should be evenly deposited on the entire surface of a screen, which requires the use of difficult techniques and expensive equipment and thus results in an increase in manufacturing costs. Therefore, there is a clear limit in manufacturing a wide screen FED.

In the industry of FEDs, research on methods of forming a flat emitter of an FED, which can emit sufficient amounts of electrons even at a low driving voltage and, eventually, can simplify processes of manufacturing the FED, is under way. Current trends in the FED industry show that carbon-based materials, for example, graphite, diamond, diamond-like carbon (DLC), fulleren (C60), or carbon nano-tubes (CNTs), are suitable for the manufacture of a flat emitter and the CNTs, in particular, are considered most desirable because they can successfully emit electrons even at a low driving voltage.

In order to have an FED display images of good quality, the electron beam emanating from the emitter must be focused and must not disperse too much so that only the phosphor layer in the intended pixel and not phosphor in neighboring pixels are impacted by the electron beam. Therefore, what is needed is an FED with superior image quality brought on by an improved design of the emitter so that the electron beam emanating from the emitter is focused and does not disperse too much so that the electron beam hits phosphor in the desired pixel and not phosphor in neighboring, unintended pixels.

SUMMARY OF THE INVENTION

It is therefore an object of the present invention to provide an improved FED.

It is also an object of the present invention to provide a design for an FED that improves image quality by better controlling the amount of dispersion of electron beams emanating from an emitter.

It is also an object of the present invention to provide an FED and an emitter design that improves the focusing characteristics of electron beams emanating from the emitter.

It is still an object of the present invention to provide an improved design for an emitter in an FED that results in an improved image quality.

These and other objects can be achieved by an improved field emission display (FED) design. The FED includes a first substrate, a cathode electrode formed on the first substrate, a conductive layer formed on the cathode electrode to have a first aperture, through which the cathode electrode is partially exposed, an insulation layer formed on the conductive layer to have a second aperture, which is connected to the first aperture, a gate electrode formed on the insulation layer to have a third aperture, which is connected to the second aperture, emitters formed on the cathode electrode exposed through the first aperture, the emitters being disposed a predetermined distance apart from each other at either side of the first aperture, and a second substrate disposed to face the first substrate with a predetermined distance therebetween, the second substrate, having an anode electrode and a fluorescent layer formed thereon.

A cavity may be formed in the cathode electrode between the emitters so that the first substrate can be exposed therethrough. The first, second, and third apertures and the cavity may be rectangles extending in a longitudinal direction of the cathode electrode. The widths of the third and second apertures may be larger than the width of the first aperture, and the width of the cavity is smaller than the width of the first aperture. The predetermined distance between the emitters may be smaller than the width of the first aperture, and the width of the cavity may be smaller than the distance between the emitters. The width of the third aperture may be the same as the width of the second aperture. The width of the third aperture may be larger than the width of the second aperture.

Conductive layers may be formed at both sides of the cathode electrode and may extend in the longitudinal direction of the cathode electrode, and the first aperture may be formed between the conductive layers. Conductive layers may be formed at both sides of the cathode electrode to have a predetermined length, and the first aperture may be formed between the conductive layers. The conductive layer may be formed on the cathode electrode to surround the first aperture. The conductive layer may include an insulation material layer formed to cover a top surface and side surfaces of the cathode electrode and a metal layer formed on the insulation material layer. A plurality of first apertures, a plurality of second apertures, and a plurality of third apertures may be formed for each pixel, and the emitters may be formed in each of the plurality of first apertures. The emitters may be formed of a carbon-based material. The emitters may be formed of carbon nano-tubes.

According to another aspect of the present invention, there is provided a field emission display (FED). The FED includes a first substrate, a cathode electrode formed on the first substrate, a conductive layer formed on the cathode electrode to have a first circular aperture, through which the cathode electrode is partially exposed, an insulation layer formed on the conductive layer to have a second circular aperture, which is connected to the first circular aperture, a gate electrode formed on the insulation layer to have a third circular aperture, which is connected to the second circular aperture, an emitter formed as a ring on the cathode electrode exposed through the first circular aperture, the emitter being disposed along an inner circumference of the first circular aperture, and a second substrate disposed to face the first substrate with a predetermined distance therebetween, the second substrate, on which an anode electrode and a fluorescent layer having a predetermined pattern are formed.

A cavity may be formed in the cathode electrode in the emitter to be circular so that the first substrate can be exposed therethrough. A plurality of first circular apertures, a plurality of second circular apertures, and a plurality of third circular apertures may be formed for each pixel, and the emitter may be formed in each of the plurality of first circular apertures.

According to another aspect of the present invention, there is provided a field emission display (FED). The FED includes a first substrate, a cathode electrode formed on the first substrate, an insulation material layer formed on the cathode electrode, a conductive layer formed on the insulation material layer, a first aperture formed through the insulation material layer and the conductive layer so that the cathode electrode can be partially exposed therethrough, an insulation layer formed on the conductive layer to have a second aperture, which is connected to the first aperture, a gate electrode formed on the insulation layer to have a third aperture, which is connected to the second aperture, emitters formed on the cathode electrode exposed through the first aperture, the emitters being disposed at both sides of the first aperture so that they can be a predetermined distance apart from each other, and a second substrate disposed to face the first substrate with a predetermined distance therebetween, the second substrate, on which an anode electrode and a fluorescent layer having a predetermined pattern are formed. The conductive layer may be insulated from the cathode electrode by the insulation material layer.

According to another aspect of the present invention, there is provided a field emission display (FED). The FED includes a first substrate, a cathode electrode formed on the first substrate, an insulation material layer formed on the cathode electrode, a conductive layer formed on the insulation material layer, a first circular aperture formed through the insulation material layer and the conductive layer so that the cathode electrode can be partially exposed therethrough, an insulation layer formed on the conductive layer to have a second circular aperture, which is connected to the first circular aperture, a gate electrode formed on the insulation layer to have a third circular aperture, which is connected to the second circular aperture, an emitter formed as a ring on the cathode electrode exposed through the first circular aperture, the emitter being disposed along an inner circumference of the first circular aperture, and a second substrate disposed to face the first substrate with a predetermined distance therebetween, the second substrate, on which an anode electrode and a fluorescent layer having a predetermined pattern are formed. The conductive layer may be insulated from the cathode electrode by the insulation material layer.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1A:
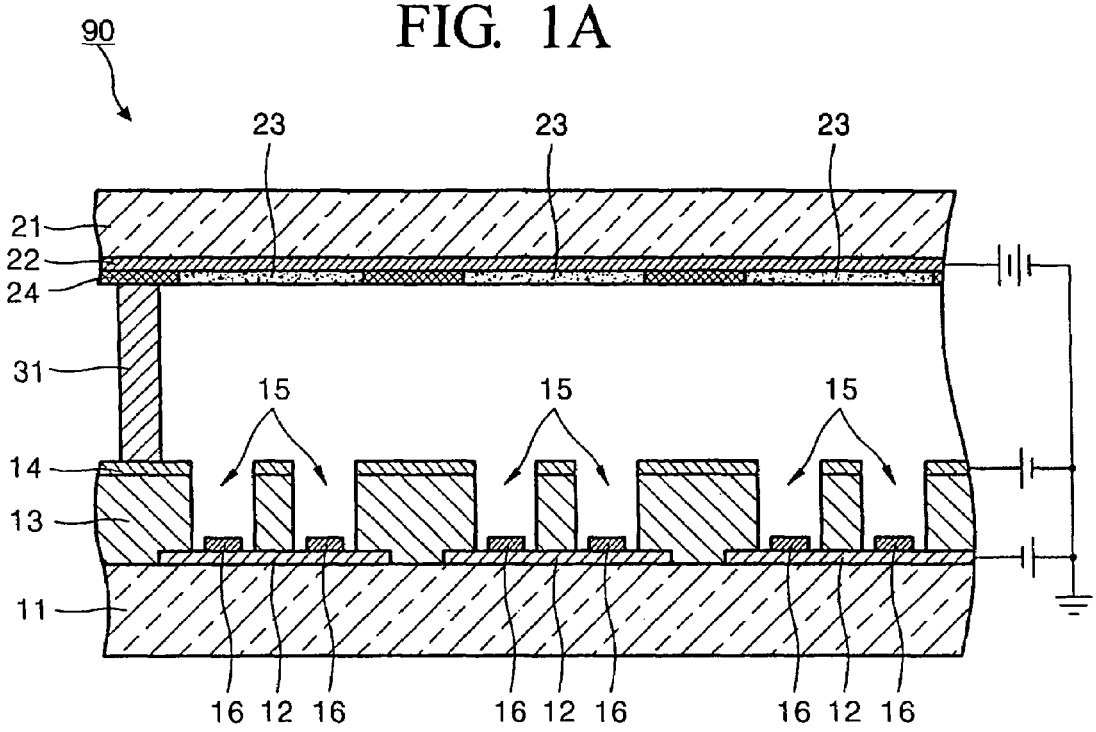
FIGS. 1A and 1B are a cross-sectional view and a plan view, respectively, of a field emission display (FED)
Figure 1B:
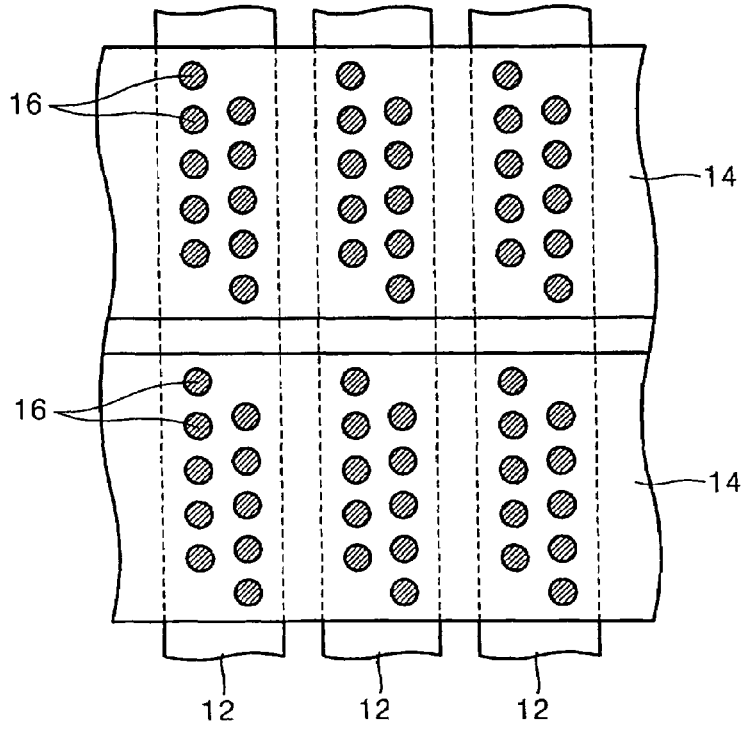

Turning now to the figures, FIGS. 1A and 1B are a cross-sectional view and a plan view, respectively, of an FED 90. Referring to FIGS. 1A and 1B, the FED 90 has a triode structure made of a cathode electrode 12, an anode electrode 22, and a gate electrode 14. The cathode electrode 12 and the gate electrode 14 are formed on a rear substrate 11, and the anode electrode 22 is formed at the bottom of a front substrate 21. A fluorescent layer 23 is formed of R, G, and B fluorescent materials, and a black matrix 24 is formed on the bottom surface of the anode electrode 22 so as to improve contrast. The rear substrate 11 and the front substrate 21 are a predetermined distance apart from each other. The predetermined distance between the rear substrate 11 and the front substrate 21 is maintained by a spacer 31 disposed between the rear substrate 11 and the front substrate 21. When manufacturing the FED 90, the cathode electrode 12 is formed on the rear substrate 11, an insulation layer 13 and the gate electrode 14, both perforated by minute apertures 15, are deposited on the rear substrate 11, and an emitter 16 is formed in each of the apertures 15 on top of the cathode electrode 12.

The FED 90 of FIGS. 1A and 1B, however, may lack good color purity and general picture quality for the following reasons. Most of the electrons emitted from the emitter 16 come from edges of the emitter 16. The electrons are converted into an electron beam, and the electron beam proceeds to the fluorescent layer 23. However, when proceeding to the fluorescent layer 23, the electron beam may disperse due to a voltage of several to dozens of volts applied to the gate electrode 14, in which case, the electron beam illuminates not only a fluorescent material of a desired pixel but also fluorescent materials of other pixels adjacent to the desired pixel.

In order to minimize the tendency of the electron beam emitted from the emitter to disperse toward the fluorescent layer 23, a plurality of emitters, each having a smaller area than the emitter 16 corresponding to one pixel, can be disposed on the cathode electrode 12 in each of the apertures 15. In this case, however, there is a clear limit as to the number of emitters that can be satisfactorily formed for each pixel having a predetermined size, the entire area of the emitter 16 for illuminating a fluorescent material of one pixel decreases, and an electron beam is not focused sufficiently.

Figure 2A:
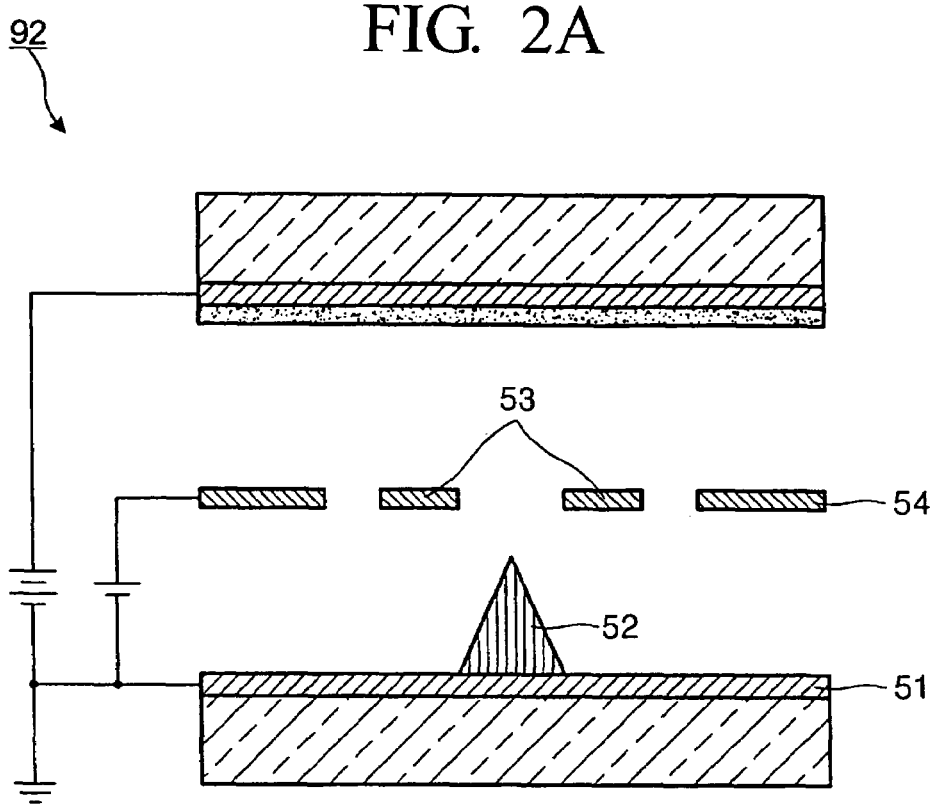
FIGS. 2A and 2B are cross-sectional views of other FEDs.
Figure 2B:
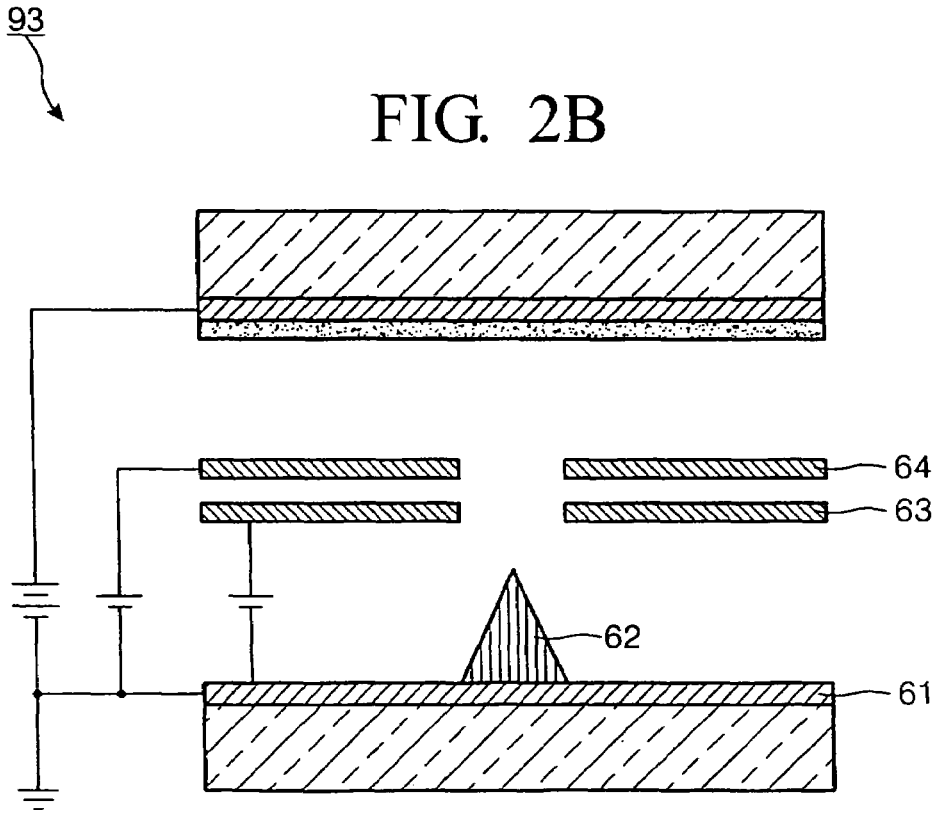

In order to prevent an electron beam from dispersing when proceeding to a fluorescent layer, another FEDs respectively having structures, which are illustrated in FIGS. 2A and 2B, can be considered. The FEDs 92 and 93 of FIGS. 2A and 2B respectively each include an additional electrode disposed near a gate electrode to enhance the focusing characteristics of electron beams.

More specifically, in the FED 92 of FIG. 2A, a focusing electrode 54, which is ring-shaped, is disposed around a gate electrode 53. In the FED 93 of FIG. 2B, a double gate structure having a lower gate electrode 63 and an upper gate electrode 64 is provided to focus electron beams. However, the FEDs of FIGS. 2A and 2B have a relatively complicated structure. In addition, the structure of the FEDs 92 and 93 of FIG. 2A or 2B, in which an emitter 52 or 62, which is a metallic micro-tip, is formed on a cathode electrode 51 or 61, has not yet been proven satisfactorily fruitful when it comes to its application to an FED having a flat emitter.

In the meantime, U.S. Pat. No. 5,552,659 Macaulay et al. discloses an electron emitter that reduces electron emission divergence by imposing restrictions on a ratio between the thickness of a non-insulation layer formed on a substrate where the electron emitter is formed and the thickness of a dielectric layer and a ratio between the diameter of a hole formed through the non-insulation layer, the dielectric layer, and a gate layer formed on the dielectric layer and the thickness of the non-insulation layer. However, it is very difficult to manufacture the electron emitter because the electron emitter has a very complicated structure in which a plurality of holes are formed to correspond to each pixel, and a plurality of electron emitters are formed in each of the holes. In addition, there are spatial restrictions in manufacturing the electron emitter. Therefore, there is a limit in maximizing the number and area of emitters corresponding to each pixel, and the lifetime of the emitters may be shortened when driving the emitters for a long time.

Figure 3:
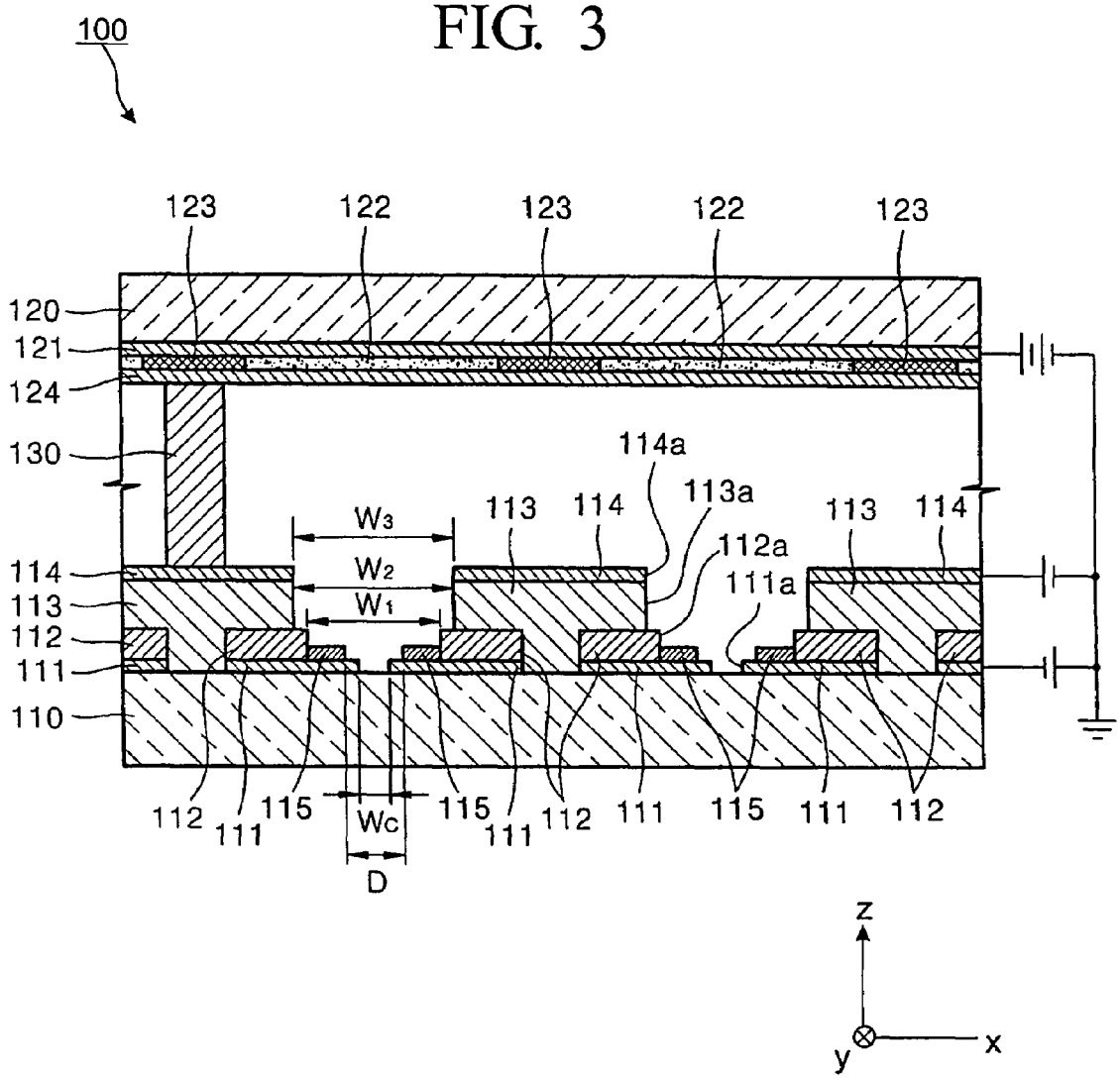
FIG. 3 is a cross-sectional view of an FED according to a first embodiment of the present invention.
Figure 4:
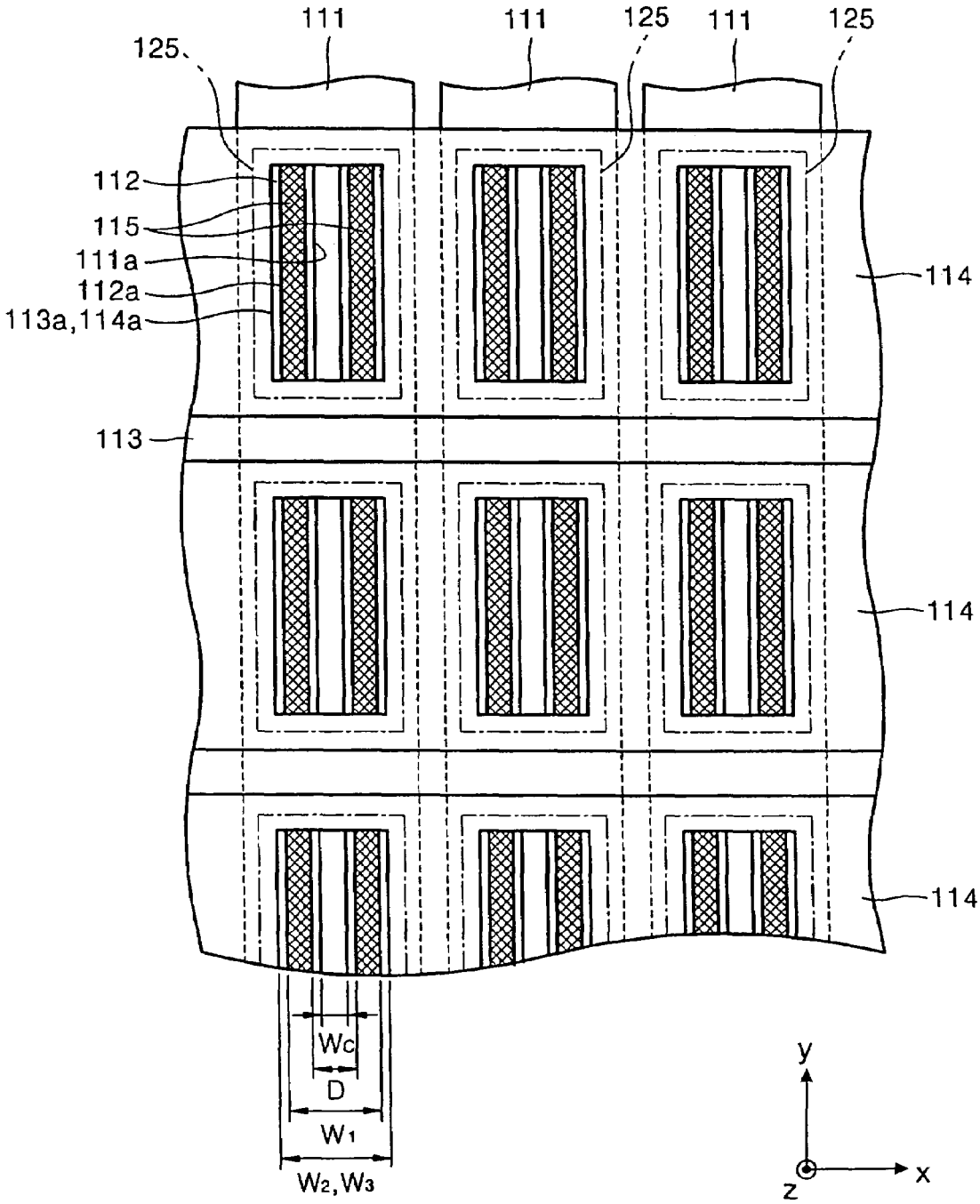
FIG. 4 is a plan view of the FED of FIG. 3.

Turning now to FIGS. 3 and 4, FIGS. 3 and 4 are a cross-sectional view and a plan view, respectively, of a field emission display (FED) 100 according to a first embodiment of the present invention. Referring to FIGS. 3 and 4, the FED 100 includes two substrates, i.e., a first substrate 110, which is also referred to as a rear substrate, and a second substrate 120, which is also referred to as a front substrate. The rear substrate 110 and the front substrate 120 are formed so that they can be separated from each other by a predetermined distance. A spacer 130 is disposed between the rear substrate 110 and the front substrate 120 so that the predetermined distance therebetween can be maintained. The rear and front substrates 110 and 120 are typically formed of glass substrates.

A structure that can emit electrons is formed on the rear substrate 110, and a structure that can realize images using the emitted electrons is formed on the front substrate 120. More specifically, a plurality of cathode electrodes 111 are arranged on the rear substrate 110 at regular intervals in a predetermined pattern, for example, as stripes. The cathode electrodes 111 are formed by depositing a conductive metallic material or a transparent conductive material, such as indium tin oxide (ITO), on the rear substrate 110 to a thickness of, for example, several hundreds to several thousands of Å and patterning the deposited conductive metallic material or transparent conductive material as stripes. The material of the cathode electrodes 111 may be determined depending on how emitters 115 are formed, which will be described in greater detail later.

Cavities 111*a*, having a width Wc are preferably formed in the cathode electrodes 111 and perforate cathode electrodes 111 so that the rear substrate 110 can be exposed therethrough. Each of the cavities 111*a* is disposed between emitters 115. It is within the scope of the invention not to have any cavities formed perforating the cathode electrode 111. Also, it is within the scope of the invention to have more than one cavity per pixel, as will be discussed in FIGS. 9 and 10. For the FED 100 of FIG. 3, there will be a one-to-one correspondence between the cavities 111*a* perforating the cathode electrode 111 and the pixels 125. In addition, the cavities 111*a* may be formed, in consideration of the shape of their respective pixels 125, as rectangles extending longer in the longitudinal (or +/−y) direction of the cathode electrodes 111, i.e., rather than in the latitudinal (+/−x) direction.

A conductive layer 112 is formed on each of the cathode electrodes 111 so as to be electrically connected to each of the cathode electrodes 111. The conductive layer 112 may be formed to a thickness of about 2-5 μm by coating a conductive paste on each of the cathode electrodes 111 using a screen printing method and plasticizing the conductive paste at a predetermined temperature. First apertures 112*a* having width $W_1$, through which the cathode electrodes 111 are partially exposed, are formed in and perforate the conductive layer 112. The first apertures 112*a* may be formed as rectangles that extend longer in the longitudinal direction of the cathode electrodes 111 (i.e., the Y direction) than in the latitudinal direction of the cathode electrodes 111 (i.e., the X direction) so that first aperture 112*a* can correspond to one of the pixels 125. In a case where the cavities 111*a* are formed in the cathode electrodes 111, as described above, the first apertures 112*a* are formed to have a width $W_1$, which is larger than a width $W_c$ of the cavities 111*a*, so that they can be connected to their respective cavities 111*a*.

An insulation layer 113 is formed on the conductive layer 112. The insulation layer 113 is formed on the entire surface of the rear substrate 110 so that not only the top surface of the conductive layer 112 but also the rear substrate 110 exposed between the cathode electrodes 111 can be covered with the insulation layer 113, as shown in FIG. 3. The insulation layer 113 may be formed to a thickness of about 10-20 μm by coating a paste-type insulating material on the rear substrate 110 using a screen printing method and plasticizing the insulating material at a predetermined temperature. Second apertures 113*a* having width $W_2$ are formed in the insulating layer 113 to perforate the insulating layer 113 so that they can be connected to their respective first apertures 112*a*. The second apertures 113*a* may be formed as rectangles that extend longer in the longitudinal direction of the cathode electrodes 111 (i.e., the Y direction) rather than in the latitudinal direction (i.e., the X direction) so that the second apertures 113*a* can form a one-to-one correspondence with the pixels 125. In addition, the second apertures 113*a* are formed to have a width $W_2$, which is larger than the width $W_1$ of the first apertures 112*a*. Accordingly, the conductive layer 112 is partially exposed through the second apertures 113*a*.

A plurality of gate electrodes 114 are formed on the insulation layer 113 at regular intervals in a predetermined pattern, for example, as stripes. The gate electrodes 114 extend in a direction perpendicular to the longitudinal direction of the cathode electrodes 111 (the Y direction), i.e., in the X direction. The gate electrodes 114 may be formed by depositing a conductive metal, e.g., chrome (Cr), on the insulation layer 113 using a sputtering method and patterning the conductive metal into stripes. Third apertures 114*a* having width $W_3$, which are connected to their respective second apertures 113*a*, are each formed in and perforate the gate electrodes 114. The third apertures 114*a* have the same shape as the second apertures 113*a*. The third apertures 114*a* may have a width $W_3$, which is the same as the width $W_2$ of the second apertures 113*a* as in FIG. 3 or a width greater than $W_2$ as in FIG. 6.

The emitters 115 are formed on each of the exposed portions of the cathode electrodes 111 exposed through the first apertures 112*a*. The emitters 115 are formed to have a smaller thickness than the conductive layer 112 and are formed to be flat on the cathode electrodes 111. The emitters 115 emit electrons when affected by an electric field generated by voltage applied between the cathode electrodes 111 and the gate electrodes 114. In the present invention, the emitters 115 are formed of a carbon-based material, for example, graphite, diamond, diamond-like carbon (DLC), fulleren ($C_{60}$), or carbon nano-tubes (CNTs). Preferably, the emitters 115 are formed of CNTs, in particular, so that they can smoothly emit electrons even at a low driving voltage.

In the present embodiment of FIGS. 3 and 4, the emitters 115 are disposed at either side of each of the first apertures 112*a* so that they are a predetermined distance apart from each other. For example, two emitters 115 may be disposed in a first aperture 112*a* in contact with side surfaces of exposed portions of the conductive layer 112. The emitters 115 may be formed as parallel bars extending in the longitudinal direction of the first apertures 112*a* (i.e., the Y direction). Accordingly, the emitters 115 have a larger area than the emitters of FIGS. 1A, 1B, 2A, 2B and Macaulay '659, and thus can guarantee a longer lifetime than those of FIGS. 1A, 1B, 2A, 2B and Macaulay '659 when driven for a long time. In addition, in a case where the cavity 111*a* is formed between the emitters 115, as described above, a distance between the emitters 115 is smaller than the width $W_1$ of each of the first apertures 112*a* but larger than the width $W_c$ of each of the cavities 111*a*.

The emitters 115 may be formed in various manners. For example, in a first method, the emitters 115 may be formed by coating a photosensitive CNT paste on the top surface of the rear substrate 110, applying ultraviolet (UV) rays to the bottom surface of the rear substrate 110 to selectively expose the photosensitive CNT paste, and developing the photosensitive CNT paste. In this case, the cathode electrodes 111 should be formed of a transparent conductive material, i.e., ITO, and the conductive layer 112 and the insulation layer 113 should be formed of an opaque material.

Alternatively, in a second method, the emitters 115 may be formed in the following manner. A catalyst metal layer of Ni or Fe is formed on the top surface of each of the cathode electrodes 111 exposed through the first aperture 112*a*, and CNTs are vertically grown from the surface of the catalyst metal layer by supplying a carbon-based gas, such as $CH_4$, $C_2H_2$, or $CO_2$, to the catalyst metal layer. Still alternatively, in a third method, the emitters 115 may be formed by depositing photoresist in the first aperture 112*a*, patterning the photoresist so that the photoresist can remain only on predetermined portions of the top surfaces of the cathode electrodes 111 where the emitters 115 are to be formed, coating a CNT paste on the remaining photoresist, and heating the rear substrate 110 to a predetermined temperature to enable the CNT paste to thermally react to the remaining photoresist. The second and third methods of forming the emitters 115 are free from the restriction of the first method of forming the emitters 115 as to the materials of the cathode electrodes 111, the conductive layer 112 and the insulation layer 113.

Figure 5A:
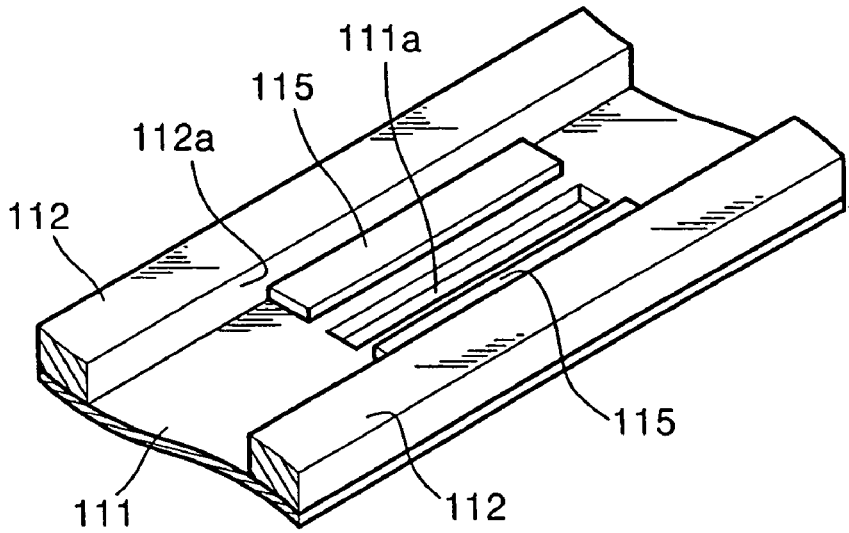
FIGS. 5A, 5B, and 5C are perspective views of three examples of a conductive layer formed on each cathode electrode of the FED of FIG. 3.
Figure 5B:
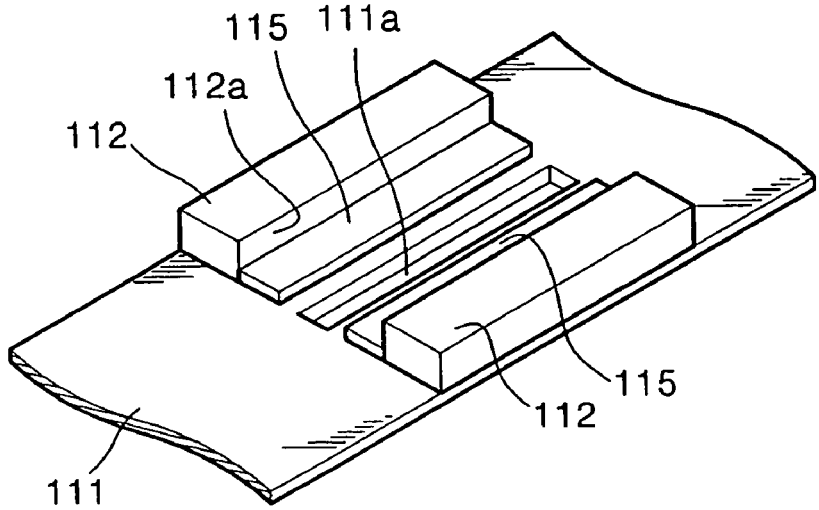
Figure 5C:
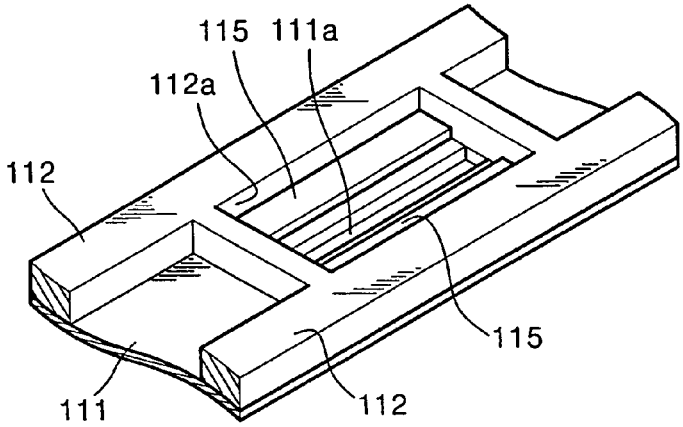

Turning now to FIGS. 5A, 5B and 5C, FIGS. 5A, 5B, and 5C illustrate three examples of the conductive layer 112 formed on one of the cathode electrodes 111. Referring to FIG. 5A, conductive layers 112 are respectively formed at both sides of a cathode electrode 111 to extend in the longitudinal (+/−y) direction of the cathode electrode 111, in which case, a first aperture 112*a* is formed between the conductive layers 112. Emitters 115 are formed between the conductive layers 112 to have a predetermined length in the longitudinal (+/−y) direction of the conductive layers 112 and contact side surfaces of the conductive layers 112. A cavity 111*a* is formed in the cathode electrode 111 between the emitters 115 to have the same length as the emitters 115.

Referring to FIG. 5B, conductive layers 112 are formed at either side of a cathode electrode 111 to have a predetermined length, and a first aperture 112*a* is formed therebetween. In the case of FIG. 5B, the conductive layers 112 are illustrated as having the same length as emitters 115.

Referring to FIG. 5C, a conductive layer 112 is formed in the form of a closed polygon on a cathode electrode 111 so as to completely surround a first aperture 112*a*. All of the four sidewalls of a first aperture 112*a* are defined by the conductive layer 112. Accordingly, emitters 115 are completely surrounded by the conductive layer 112.

Referring now to FIGS. 3 and 4, the structure formed on the front or second substrate 120 will now be discussed. An anode electrode 121 is formed on the bottom surface of the front substrate 120, which faces the top surface of the rear substrate 110, and fluorescent layers 122 are formed of R, G, and B fluorescent materials on the anode electrode 121. The anode electrode 121 is formed of a transparent conductive material, such as ITO, so that visible rays emitted from the fluorescent layers 122 can pass therethrough. The fluorescent layers 122 are formed to extend in the longitudinal direction parallel to the cathode electrodes 111, i.e., in the Y direction.

Black matrices 123 may be formed among the fluorescent layers 122 on the bottom surface of the front substrate 120 so as to improve contrast. A metallic thin layer 124 may be formed on the fluorescent layers 122 and on the black matrices 123. The metallic thin layer 124 is formed of aluminium to have such a small thickness (e.g., several hundreds of Å) so that electrons emitted from the emitters 115 can easily pass therethrough. The R, G, and B fluorescent materials of the fluorescent layers 122 emit visible rays when excited by electron beams emitted from the emitters 115, and the visible rays emitted from the R, G, and B materials of the fluorescent layers 122 are reflected by the metallic thin layer 124. Thus, the amount of visible light radiated from the entire FED increases, and eventually, the brightness of the entire FED increases as well. In a case where the metallic thin layer 124 is formed on the front substrate 120, the anode electrode 121 may not necessarily be formed because the metallic thin layer 124 can serve as a conductive layer, i.e., an anode electrode, when voltage is applied thereto.

The rear substrate 110 and the front substrate 120 are located a predetermined distance apart from each other so that the emitters 115 can face the fluorescent layers 122. The rear substrate 110 and the front substrate 120 are bonded to each other by applying a sealing material (not shown) around them. As described above, the spacer 130 is disposed between the rear substrate 110 and the front substrate 120 so as to maintain the predetermined distance between the rear substrate 110 and the front substrate 120.

The operation of the FED according to the preferred embodiment of the present invention will now be described. When predetermined voltages are applied to the cathode electrodes 111, the gate electrodes 114, and the anode electrode 121, an electric field is formed among them so that electrons are emitted from the emitters 115. At this time, a voltage of zero to minus dozens of volts, a voltage of several to dozens of volts, and a voltage of hundreds to thousands of volts are applied to the cathode electrodes 111, the gate electrodes 114, and the anode electrodes 121, respectively. The conductive layer 112 is in contact with the top surface of the cathode electrodes 111, and thus the same voltage applied to the cathode electrodes 111 is applied to the conductive layer 112. The emitted electrons are converted into electron beams, and the electron beams are led to the fluorescent layers 122 so that they can eventually collide with the fluorescent layers 122. As a result, the R, G, and B fluorescent materials of the fluorescent layers 122 are excited and emit visible rays.

As described above, since the emitters 115 are disposed at either side of each of the first apertures 112*a*, electron beams, which are formed of electrons emitted from the emitters 115, are focused rather than to be widely dispersed. In addition, since the conductive layer 112 is disposed at either side of the emitters 115, the electron beams can be efficiently focused due to an electric field formed by the conductive layer 112.

Moreover, the cavity 111*a* may be formed in each of the cathode electrodes 111 so that the emitters 115 can be surrounded by equipotential lines of an electric field formed around the emitters 115. Due to the electric field, current density increases, and a peak in the current density is precisely located in each of the pixels 125 of the fluorescent layers 122. It is possible to more efficiently focus electron beams by adjusting the width $W_c$ of the cavity 111*a*.

As described above, color purity of an image can be enhanced by improving the focusing of electron beams emitted from the emitters 115, and the brightness of the image can be enhanced by precisely placing a peak in current density in each of the pixels 125. Therefore, it is possible to realize an image with high picture quality. Advantages of the FED according to the preferred embodiment of the present invention will be described in greater detail later with reference to FIGS. 11A through 13C.

Figure 6:
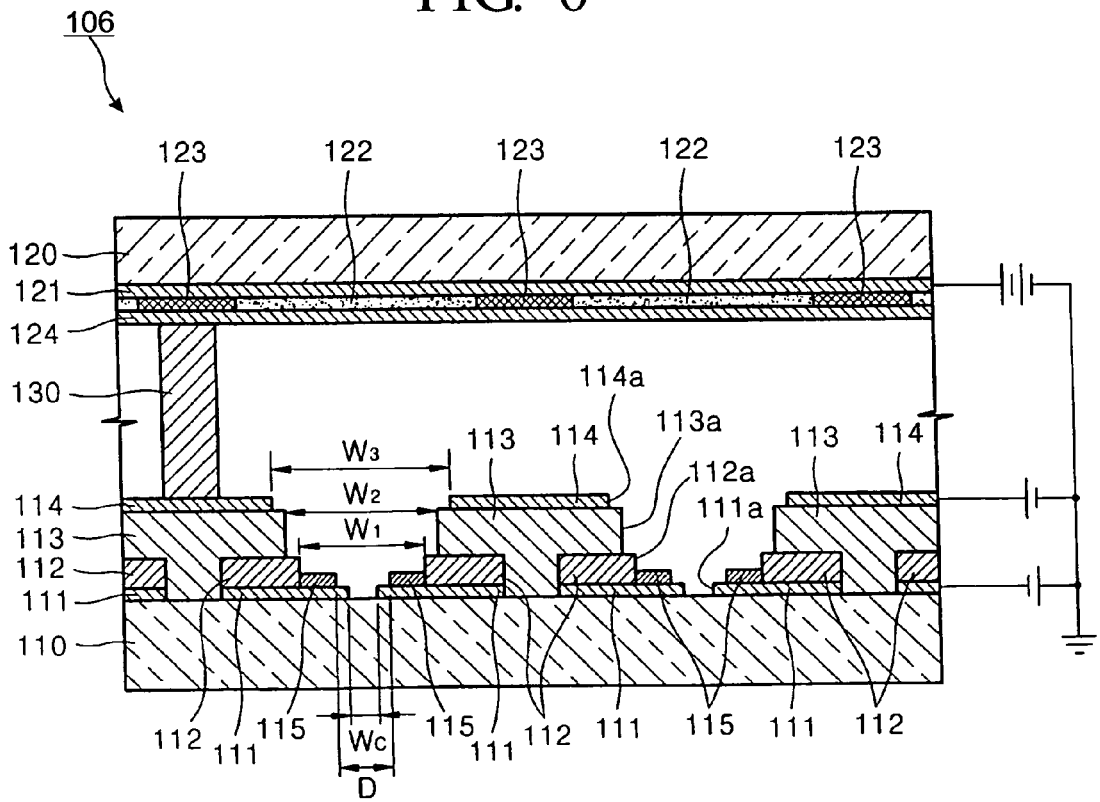
FIGS. 6, 7, and 8 are cross-sectional views of variations of the FED of FIG. 3.

Turning now to FIG. 6, FIG. 6 is a cross-sectional view of one variation of an FED according to the first embodiment of the present invention. Referring to FIG. 6, FED 106 is similar to FED 100 in FIG. 3 except that the width $W_3$ of third aperture 114*a* is larger and thus not equal to the width $W_2$ of second aperture 113*a*. By forming the third apertures 114*a* to have a larger width $W_3$ than the width $W_2$ of the second apertures 113*a*, a distance between the cathode electrodes 111 and their respective gate electrodes 114 can be lengthened, and thus, the voltage withstanding characteristics of the FED according to the first embodiment of the present invention can be improved.

Figure 7:
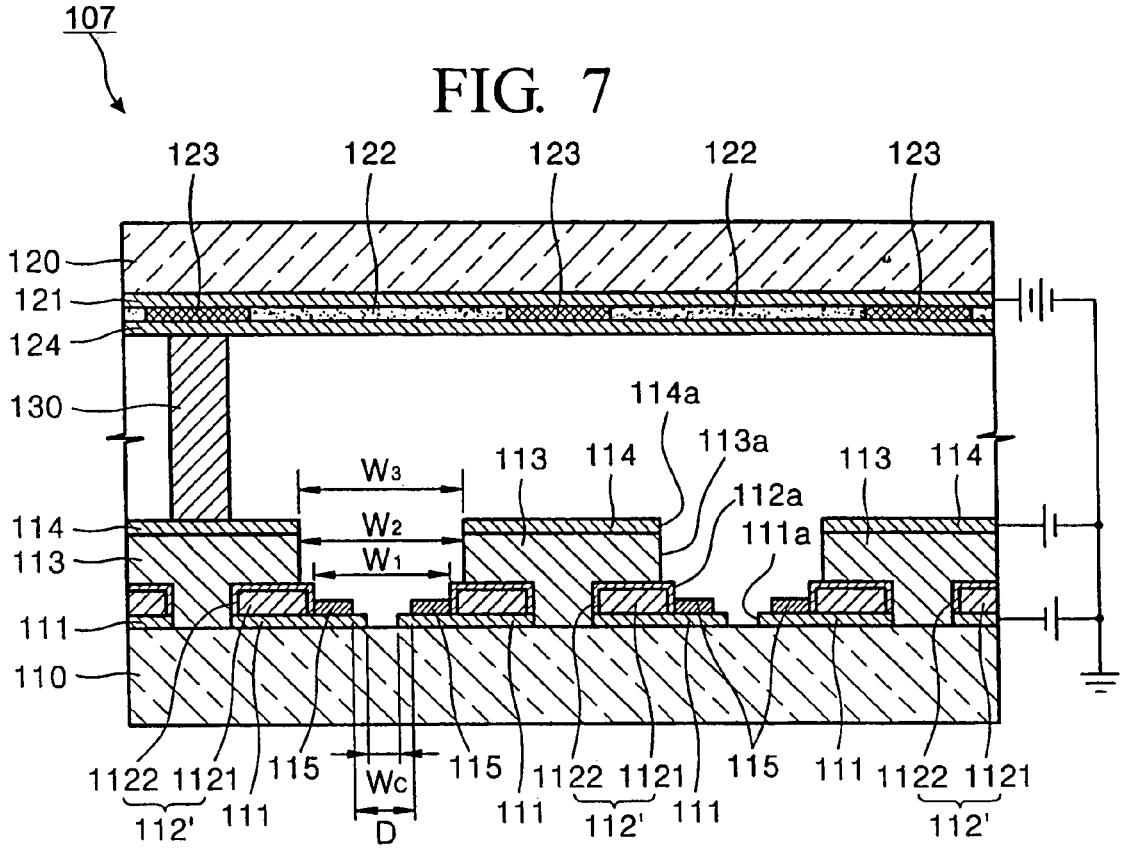

Turning now to FIG. 7, FIG. 7 illustrates yet another FED 107 according to the present invention, FED 107 being another variant of FED 100 of FIG. 3. Referring to FIG. 7, the FED 107 includes a conductive layer 112' that may include an insulation material layer 1121 formed on each of the cathode electrodes 111 and a metal layer 1122 formed to cover the top surface and side surfaces of the insulation material layer 1121, so that the metal layer 1122 is electrically connected to the cathode electrodes 111 so as to serve basic functions of the conductive layer 112'. More specifically, the conductive layer 112' may be formed by forming the insulation material layer 1121 on each of the cathode electrodes 111 and forming the metal layer 1122 on the insulation material layer 1121 through a deposition, sputtering, or plating method. The metal layer 1122 can serve as a passivation layer that protects the conductive layer 112' from an etchant when forming the second apertures 113*a* in the insulation layer 113 using the etchant. Therefore, it is possible to prevent damage to the conductive layer 112' caused by the etchant that is used to make the second apertures 113*a*. More specifically, the conductive layer 112 of FIG. 6 may be damaged by the etchant because it is formed of a conductive paste. However, the conductive layer 112' of FIG. 7 is not aversely affected by the etchant because its surface is formed of the metal layer 1122.

Figure 8:
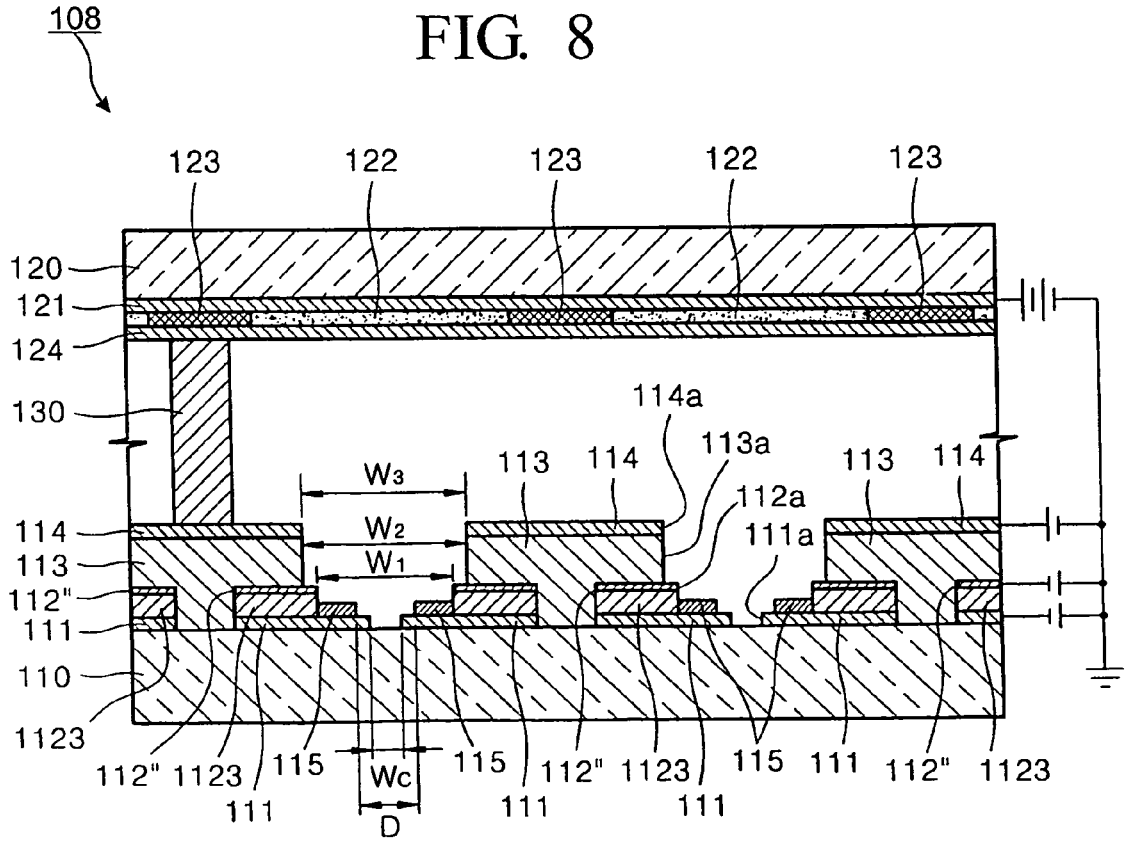

Turning now to FIG. 8, FIG. 8 illustrates yet another variant to FED 100 of FIG. 3. Referring to FED 108 in FIG. 8, an insulation material layer 1123 is formed on the cathode electrodes 111, and a conductive layer 112" is formed on the top surface of the insulation material layer 1123 so that the conductive layer 112" can be disposed as much apart from the cathode electrodes 111 as the thickness of the insulation material layer 1123 and can be electrically isolated from the cathode electrodes 111 by the insulation material layer 1123. Unlike FED 107, conductive layer 112" in FED 108 does not include the insulation material 1123. Therefore, unlike FED 107 of FIG. 7, conductive layer 112" is not electrically connected to the cathode electrode 111. In this case, the conductive layer 112" may be connected to a different power source from a power source connected to the cathode electrodes 111, and thus a different voltage from a voltage applied to the cathode electrodes 111 can be applied to the conductive layer 112". Therefore, it is possible to maximize the electron beam-focusing effect of the conductive layer 112" by controlling the voltage applied to the conductive layer 112" independently of the voltage applied to the cathode electrodes 111. Accordingly, the conductive layer 112" can serve as an independent electrode, i.e., a focusing electrode.

The conductive layer 112" may be formed by forming the insulation material layer 1123 on the cathode electrodes 111 and depositing a conductive metallic material on the top surface of the insulation material layer 1123 through a sputtering or plating method. Since the conductive layer 112" is formed of a metallic material rather than to be formed of a conductive paste, the conductive layer 112" can be prevented from being damaged by an etchant used in an etching process for forming the second apertures 113*a* in the insulation layer 113.

The rest of the elements of the FED 108 of FIG. 8 are the same as their respective counterparts of the FED 100 of FIG. 3 except that the first apertures 112*a* are formed in the insulation material layer 1123 and in the conductive layer 112" at regular intervals and the emitters 115 disposed in each of the first apertures 112*a* are formed in contact with side surfaces of the insulation material layer 1123 exposed through each of the first apertures 112*a*. In the FED 108 of FIG. 8, a longitudinal end of the conductive layer 112" may be electrically connected to each of the cathode electrodes 111, in which case, the same voltage can be applied to the conductive layer 112" and the cathode electrodes 111.

Figure 9:
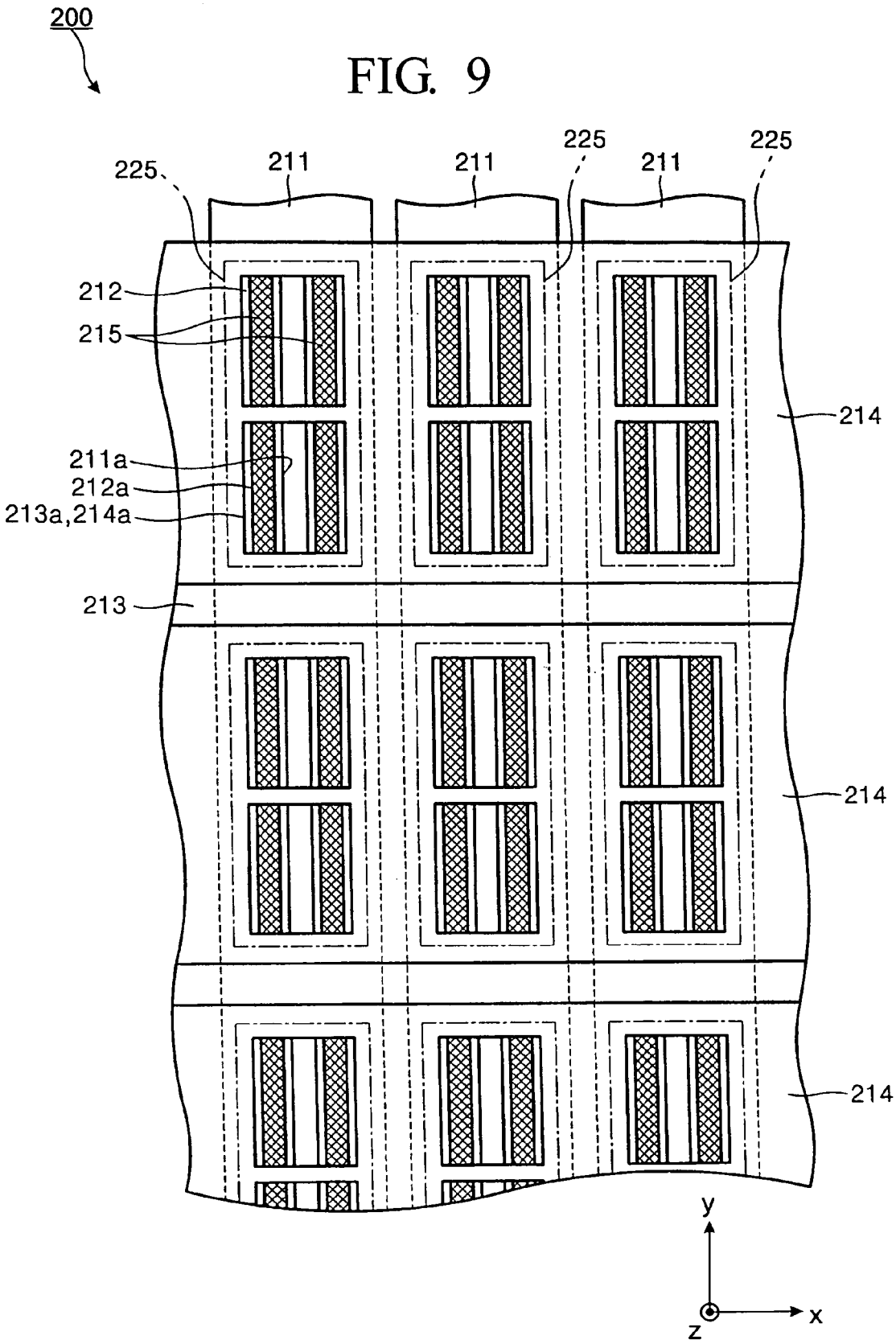
FIG. 9 is a plan view of an FED according to a second embodiment of the present invention.

FIG. 9 is a plan view of an FED 200 according to a second embodiment of the present invention. The FED according to the second embodiment of the present invention has the same cross-sectional structure as the FED according to the first embodiment of the present invention, and thus a cross-sectional view of the FED according to the second embodiment of the present invention will not be presented.

Referring to FIG. 9, in each pixel 225, a plurality of first apertures 212*a*, for example, two first apertures 212*a* are formed in a conductive layer 212, two second aperture 213*a* are formed in an insulation layer 213, and two third apertures 214*a*, are formed in a gate electrode 214. Emitters 215 are formed in each of the first apertures 212*a*. Unlike FED 100 of FIG. 3, there is now more than one set of apertures for each pixel in FED 200. The emitters 215, like the emitters 115 in the first embodiment of the present invention, are formed on a cathode electrode 211 and exposed through the first aperture 212*a*. In addition, the emitters 215 are disposed at either side of each of the first apertures 212*a* so that they are at a predetermined distance apart from each other. A plurality of cavities 211*a*, for example, two cavities 211*a*, may be formed in the cathode electrode 211 corresponding to each pixel 225.

Other elements of the FED 200 according to the second embodiment of the present invention are the same as their respective counterparts of the FED 100 according to the first embodiment of the present invention, and thus their descriptions will be omitted. The variations of the FED according to the first embodiment of the present invention, shown in FIGS. 6, 7, and 8, may also be applied to the FED 200 according to the second embodiment of the present invention.

Figure 10A:
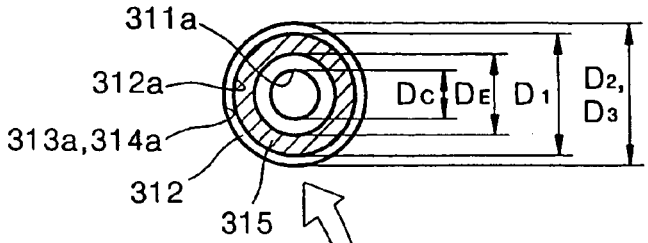
FIGS. 10A and 10B are a plan views of an FED according to a third embodiment of the present invention.
Figure 10B:
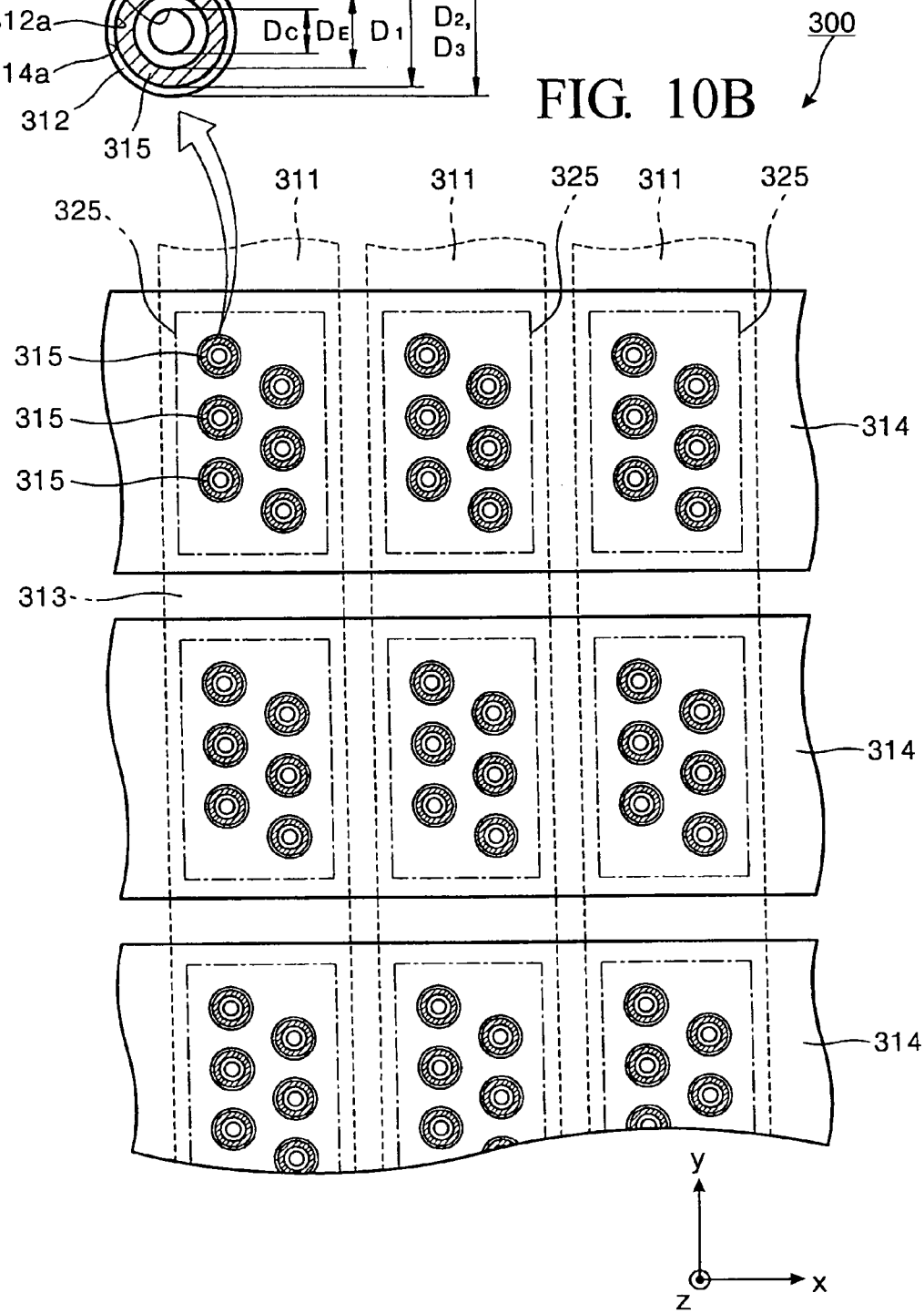

FIGS. 10A and 10B are a plan views of an FED 300 according to a third embodiment of the present invention. FIG. 10A focusses on a single emitter and FIG. 10B shows how may circular emitter structures correspond to a single pixel 325. The FED 300 according to the third embodiment of the present invention has the same cross-sectional structure as the FED 100 according to the first embodiment of the present invention, and thus a cross-sectional view of the FED 300 according to the third embodiment of the present invention will not be presented.

Referring to FIG. 10A, a first aperture 312*a* formed in a conductive layer 312, a second aperture 313*a* formed in an insulation layer 313, and a third aperture 314*a* formed in a gate electrode 314 are all circular in shape instead of rectangular as in the first embodiment. An inner diameter $D_3$ of the third aperture 314*a* and an inner diameter $D_2$ of the second aperture 313*a* are larger than an inner diameter D, of the first aperture 312*a*. In addition, the inner diameter $D_3$ of the third aperture 314 may be the same as the inner diameter $D_2$ of the second aperture 313*a*.

An emitter 315, which is ring-shaped, is formed on a cathode electrode 311 exposed through the first aperture 312*a* along an inner circumference of the first aperture 312*a*. An inner diameter $D_E$ of the emitter 315 is smaller than the inner diameter $D_1$ of the first aperture 312*a*. The emitter 315, like the emitters 115 in the first embodiment of the present invention, may be formed of a carbon-based material, e.g., CNTs.

In the third embodiment of the present invention, like in the first embodiment of the present invention, a cavity 311*a*, which is circular, may be formed to perforate the cathode electrode 311. The cavity 311*a* is disposed inside the emitter 315. Therefore, an inner diameter DC of the cavity 311*a* is smaller than the inner diameter D, of the first aperture 312*a* and the inner diameter DE of the emitter 315.

In the third embodiment of the present invention as illustrated in FIG. 10B, a plurality of first apertures 312*a*, a plurality of second apertures 313*a*, and a plurality of third apertures may be provided for each pixel 325, in which case, the emitter 315 is formed in each of the plurality of first apertures 312*a*. The rest of the elements of the FED 300 according to the third embodiment of the present invention are the same as their respective counterparts of the FED 100 according to the first embodiment of the present invention, and thus their descriptions will be omitted.

The variations of the FED according to the first embodiment of the present invention, shown in FIGS. 6, 7, and 8, may also be applied to the FED according to the third embodiment of the present invention. In other words, the inner diameter $D_3$ of the third aperture 314*a* formed in a gate electrode 314 may be larger than the inner diameter $D_2$ of the second aperture 313*a* formed in the insulation layer 313, and the conductive layer 312 may include an insulation material layer formed on the cathode electrode 311 and a metal layer formed on the insulation material layer. In addition, the conductive layer 312 may be formed on the top surface of the insulation material layer, which is formed on the cathode electrode 311.

It is to be appreciated that features from various embodiments and from various variations of embodiments may be mixed and matched to form an FED within the scope of the present invention. The aperture sizes may be rectangular, circular, have a one-to-one correspondence with the pixels or have a many-to-one correspondence with the pixels, the relative sizes of the apertures may vary and the presence or absence of a cavity are all within the scope of the present invention.

Empirical simulation results of an FED according to a preferred embodiment of the present invention and the FEDs of FIGS. 1A and 1B will now be described in the following paragraphs. In electron beam emission simulations, the FED 90 of FIGS. 1A and 1B and the FED 100 according to the first embodiment of the present invention, shown in FIG. 3, were respectively selected for an empirical comparison. More specifically, the FEDs according to the first through third embodiments of the present invention have almost the same cross-sectional structure and thus have almost the same electron beam emission characteristics, and thus, the FEDs of FIGS. 3, 6, 7, and 8 were selected as exemplary embodiments of the present invention for the electron beam emission simulations. Therefore, the FEDs according to the first embodiment and their variations were empirically tested and test results for the FEDs 200 and 300 according to the second and third embodiments are not shown as they are essentially the same as that of the first embodiment.

Before the simulations, design dimensions of the FED's tested were fixed. For example, screens of the FED 90 of FIGS. 1A and 1B and the FEDs according to the first embodiment of the present invention were each set to have an RGB trio pitch of about 0.69 mm in a case where they were designed to have an aspect ratio of 16:9, a diagonal line length of 38 inches, and a horizontal resolution of 1280 lines so as to realize high definition (HD)-level picture quality. In this case, in the FED according to the first embodiment of the present invention, an insulation layer 113 is preferably set to have a height of 10-20 μm, a conductive layer 112 is preferably set to have a height of 2-5 μm, first apertures 112*a* formed in the conductive layer 112 are preferably set to have a width $W_1$ of 60-80 μm, second apertures 113*a* formed in the insulation layer 113 are preferably set to have a width $W_2$ of 70-90 μm, third apertures 114*a* formed in gate electrodes 114 are preferably set to have a width $W_3$ of 70-95 μm, and cavities formed in cathode electrodes 111 are preferably set to have a width $W_c$ of 10-30 μm. However, the above-mentioned elements of the FED according to the first embodiment of the present invention may have different measurements from those set forth herein, depending on the size, aspect ratio, and resolution of the screen of the FED according to the first embodiment of the present invention.

Figure 11A:
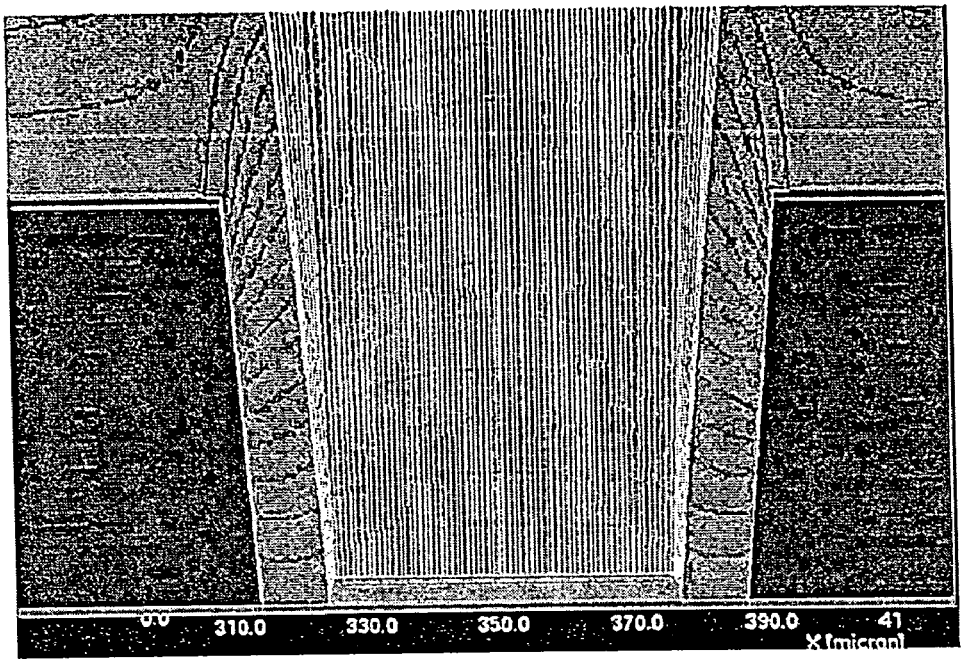
FIGS. 11A, 11B, and 11C are diagrams illustrating electron beam emission simulation results of the FED of FIG. 1.
Figure 11B:
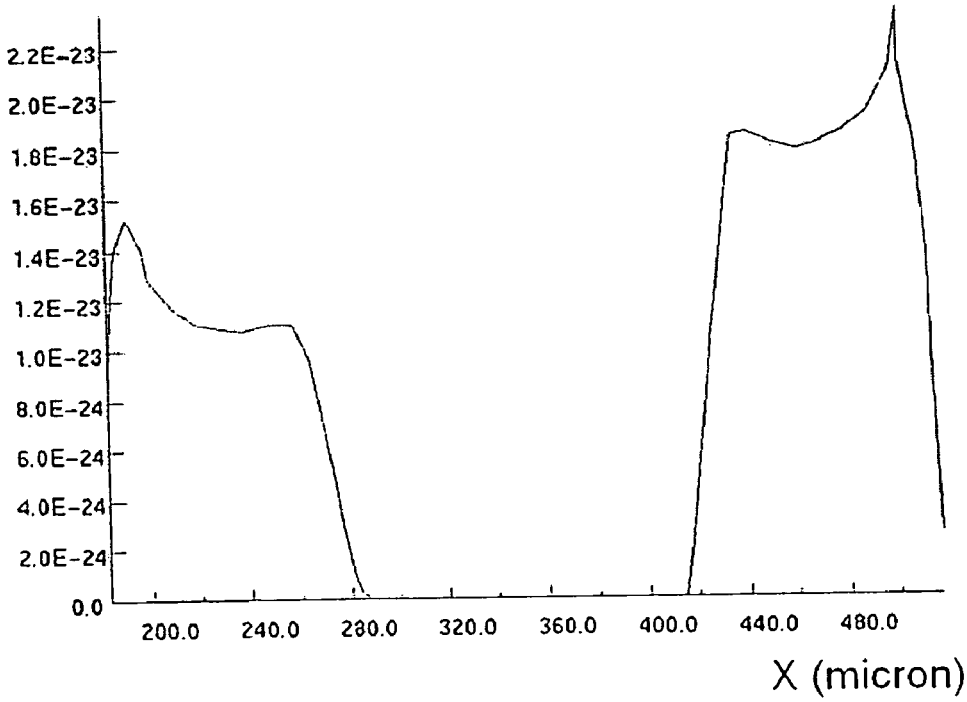
Figure 11C:
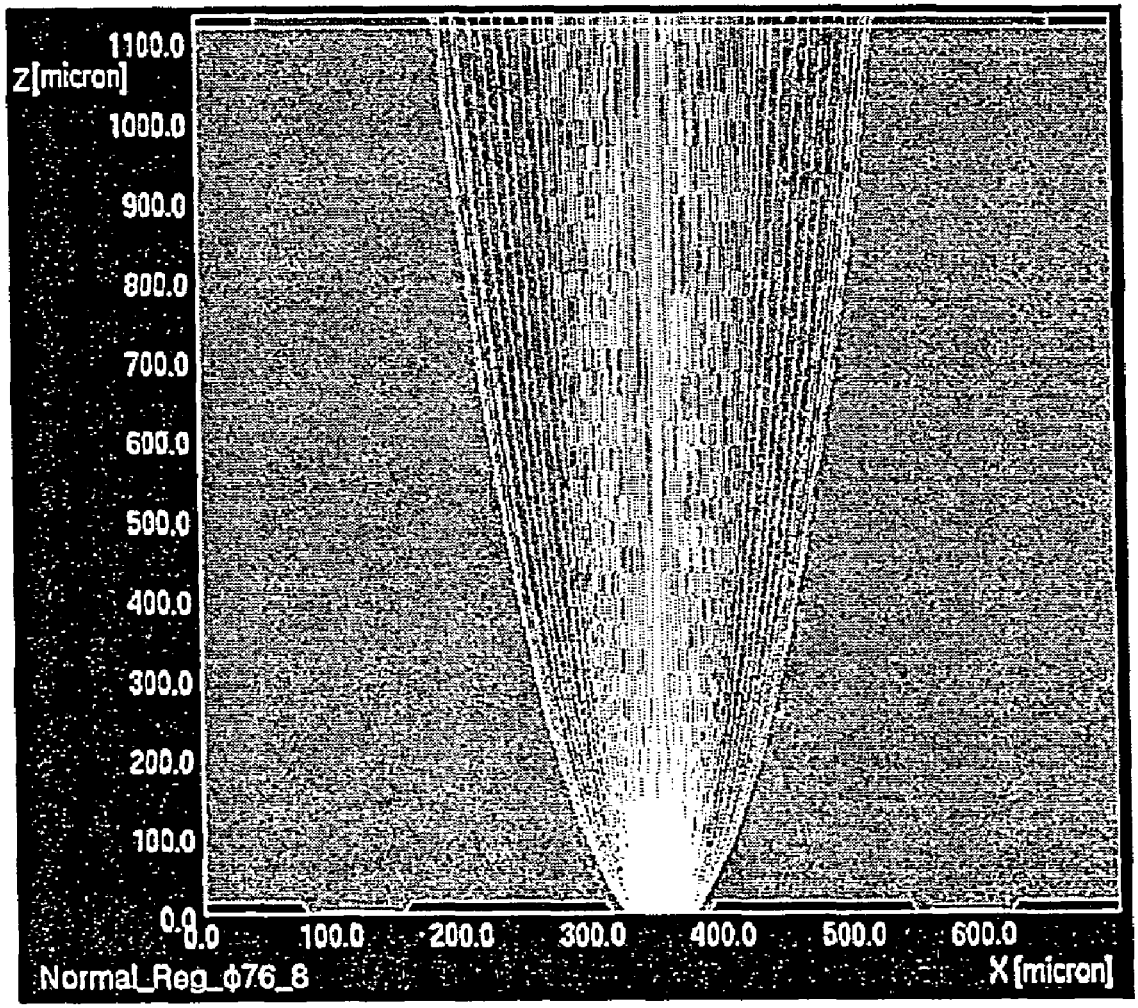

FIGS. 11A through 11C illustrate electron beam emission simulation results of the FED 90 of FIGS. 1A and 1B. Referring to FIG. 11A, an electron beam emitted from an emitter 16 of the FED 90 disperses widely toward fluorescent layers 23 of the FED 90. The vertical axis in FIG. 11B represents current density. Referring to FIG. 11B, peaks in the current density are located near the edges of a pixel, rather than the center of the pixel, because most electrons are emitted from the edges of the emitters 16, as described above. If a central portion of the pixel has a low current density, fluorescent materials of the pixel cannot be sufficiently excited, thereby decreasing the brightness of an image displayed on the screen of the FED 90. Particularly, in a case where emitters are not exactly arranged where they are supposed to be arranged, or in a case where front 21 and rear 11 substrates of the FED 90 are not precisely aligned with each other when bonding them together, peaks in current density are likely to be located near the edges of each pixel of the FED 90, which results in a considerable decrease in color purity. Referring to FIG. 11C, the spot of an electron beam arriving at a fluorescent layer of the FED undesirably encroaches upon another pixel. In short, the FED 90 of FIGS. 1A and 1B may end up in low color purity and low picture quality.

Figure 12A:
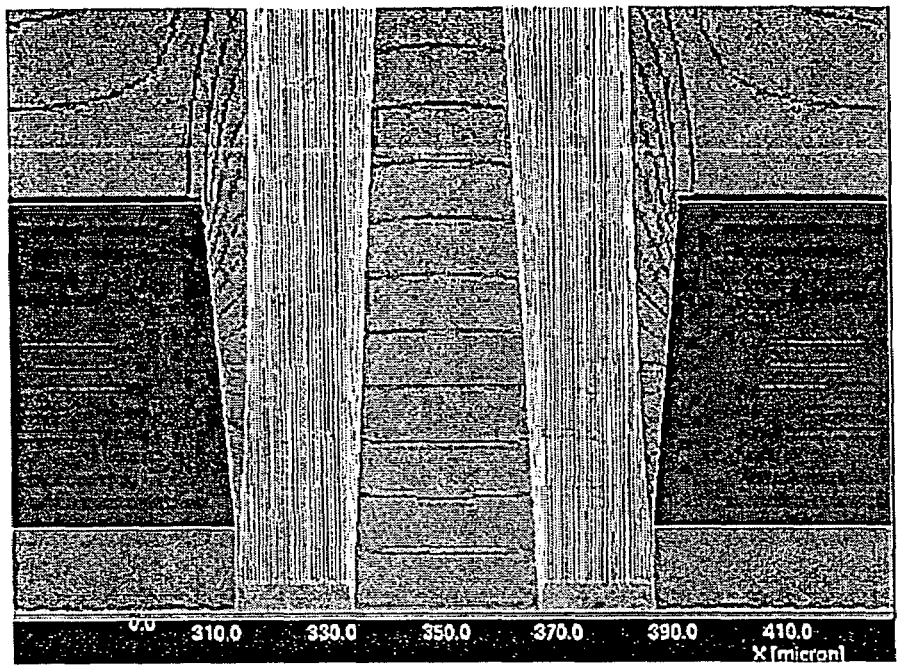
FIGS. 12A, 12B, and 12C are diagrams illustrating electron beam emission simulation results of the FED of FIG. 3 in a case where no cavity is formed in each cathode electrode of the corresponding FED.
Figure 12B:
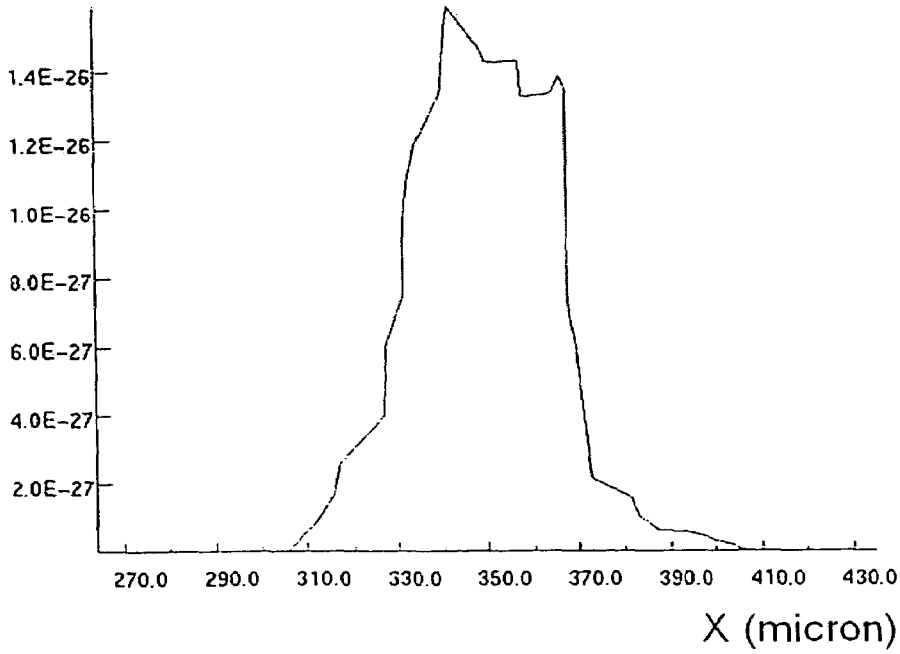
Figure 12C:
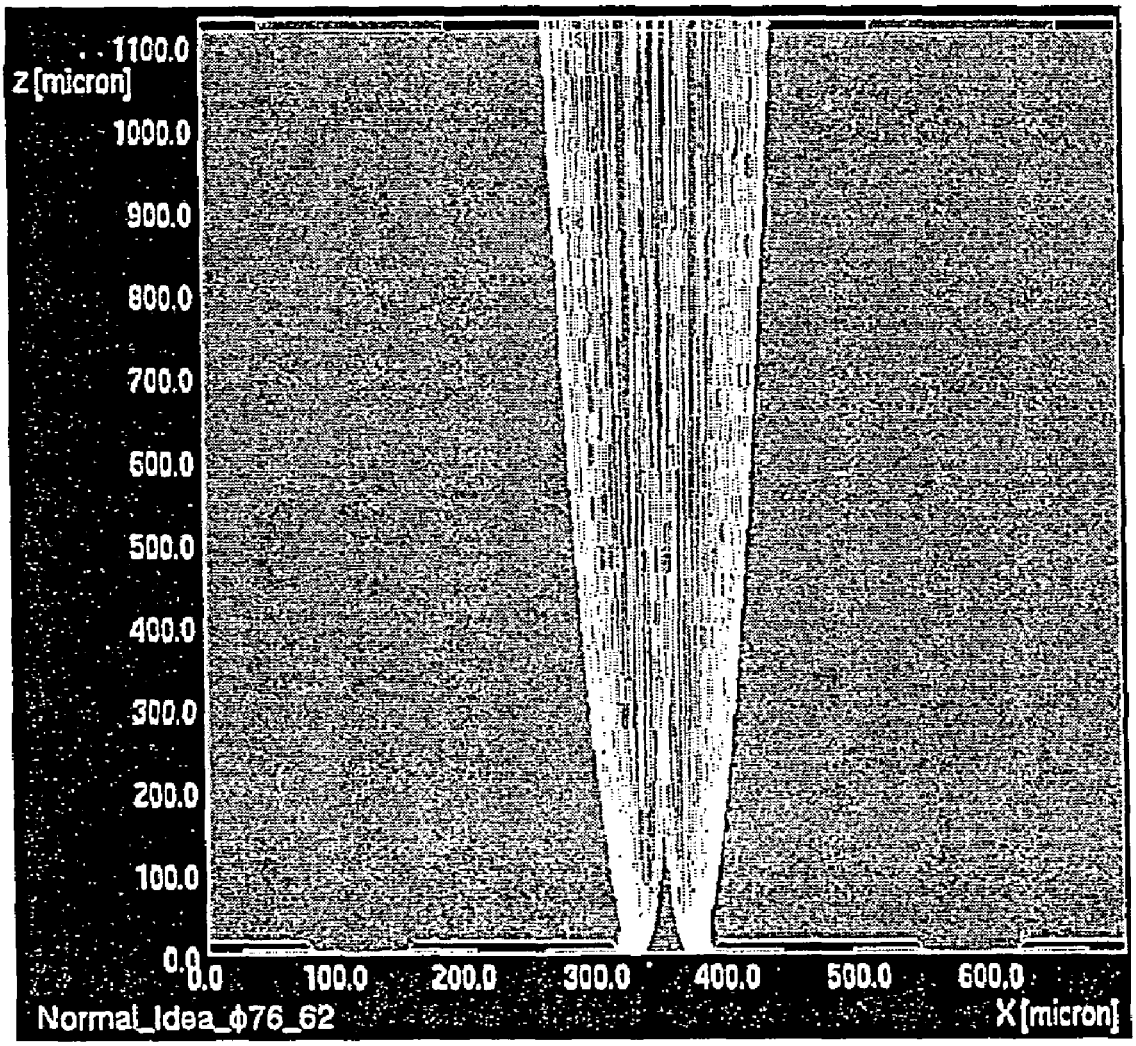

FIGS. 12A through 12C illustrate electron beam emission simulation empirical results of the FED 100 according to the first embodiment of the present invention as shown in FIG. 3, modified for the case where there is no cavity 111*a* perforating cathode electrode 111 (hereinafter referred to as modified FED 100). Referring to FIG. 12A, electron beam emitted from emitters 115 that are respectively arranged at both sides of a first aperture 112*a* of this modified FED 100 according to the first embodiment of the present invention are more focused and less dispersed than the electron beams of FED 90 of FIGS. 1A and 1B. This improvement in the electron beam of the modified FED 100 is caused by the electric field formed by the conductive layer 112. Referring to FIG. 12B, peaks in current density are generally located in a central portion of a pixel, unlike the empirical results of FED 90 illustrated in FIG. 11B.

Accordingly, as shown in FIG. 12C, the size of the spot of an electron beam arriving at a fluorescent layer is much smaller in this modified FED 100 than in FED 90, and thus it is possible to solve the problem of the FEDs of FIGS. 1A, 1B, 2A, 2B and Macauley '659 that an electron beam aimed at one pixel encroaches upon another pixel as well. Even though current density is generally lower in the electron beam of modified FED 100 than in FED 90, color purity of an image is higher for modified FED 100 than for FED 90 because the focusing characteristics of electron beams emitted from the emitters 115 of the modified FED 100 according to the first embodiment of the present invention are considerably improved, compared to FED 90 of FIGS. 1A and 1B. In addition, since peaks in the current density are located in a central portion of each pixel for modified FED 100, the brightness of an image displayed on the screen of the modified FED 100 according to the first embodiment of the present invention can be compensated for.

Figure 13A:
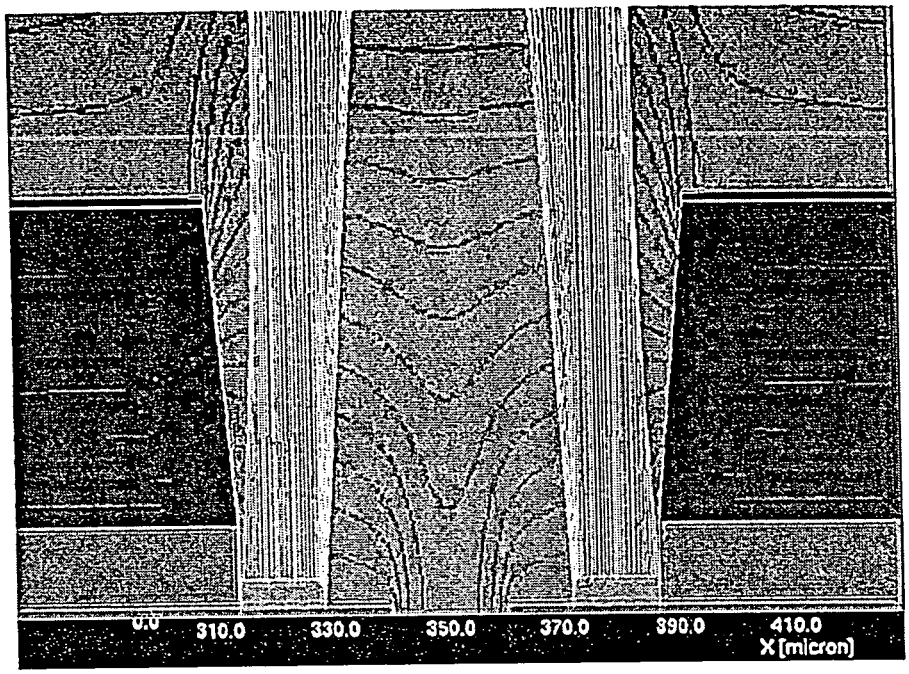
FIGS. 13A, 13B, and 13C are diagrams illustrating electron beam emission simulation results of the FED of FIG. 3 in a case where a cavity is formed in each cathode electrode of the corresponding FED.
Figure 13B:
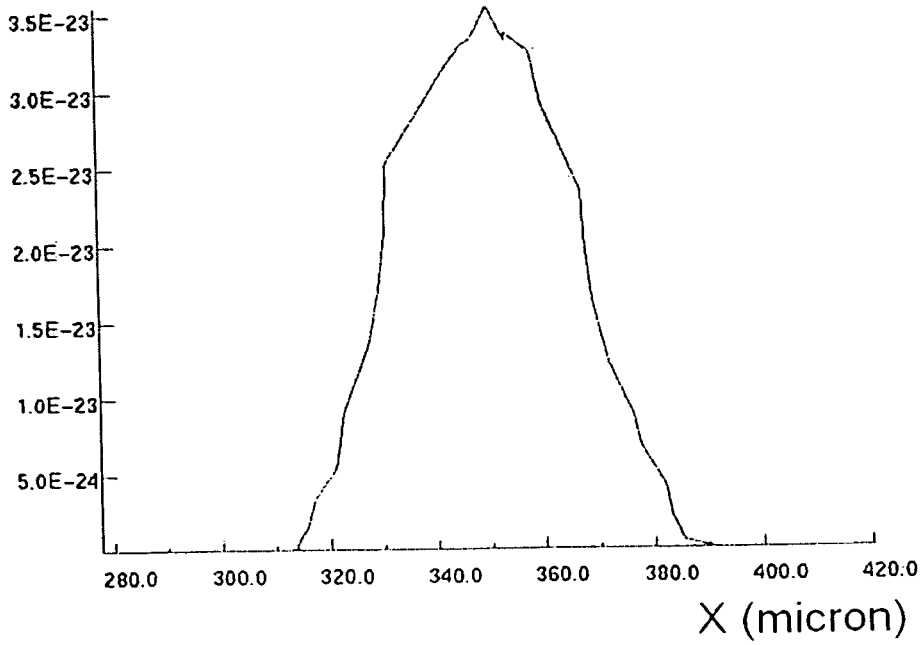
Figure 13C:
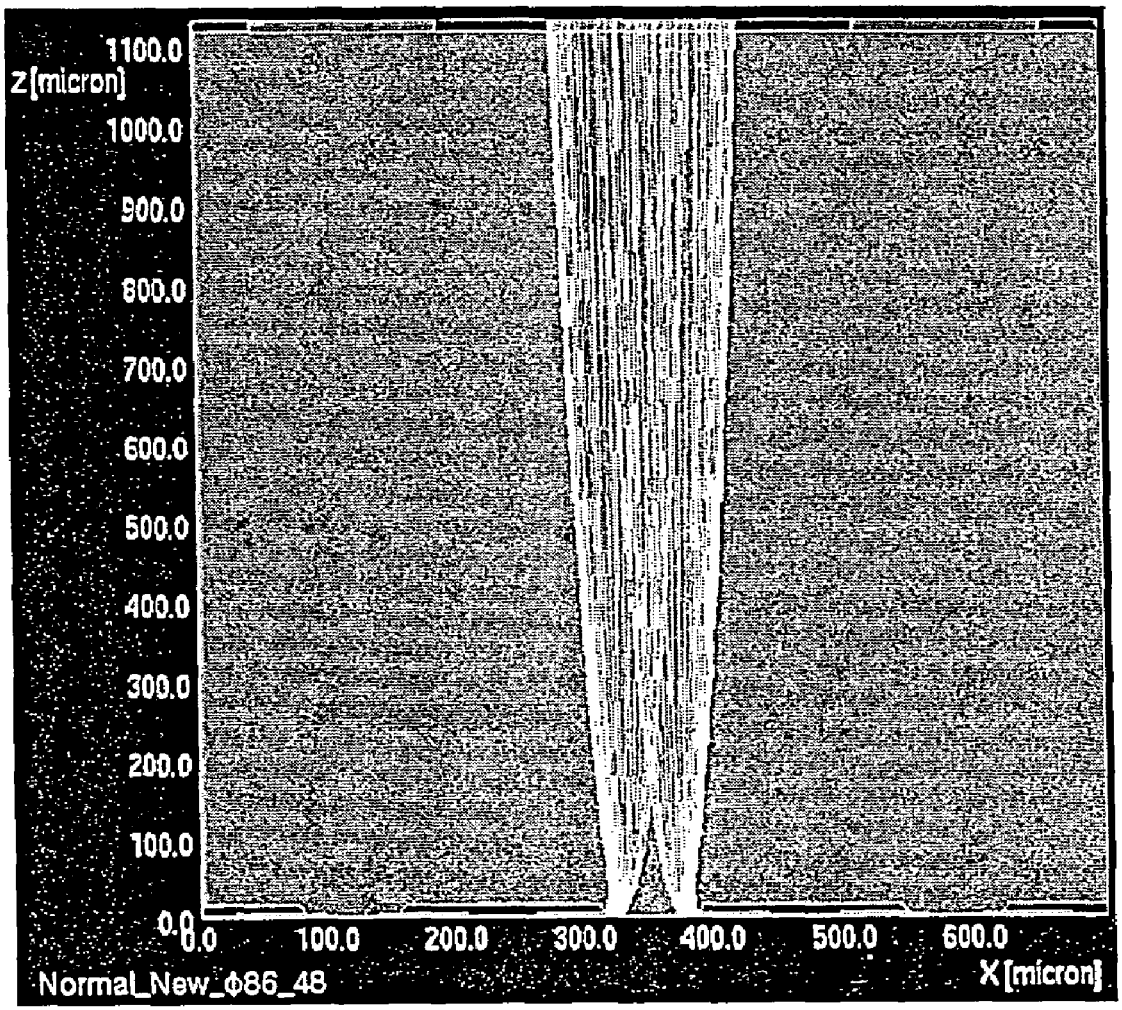

Turning to FIGS. 13A, 13B and 13C, FIGS. 13A through 13C illustrate electron beam emission simulation empirical results of the FED 100 according to the first embodiment of the present invention, shown in FIG. 3, in a case where there is a one-to-one correspondence between cavities 111*a* perforating cathode electrode 111 and pixels 125.

Referring to FIG. 13A, due to the cavity 11*a* formed in each cathode electrode 111 of the FED 100 of FIG. 3, an electric field is formed around the emitters 115 so that the emitters 115 can be surrounded by equipotential lines of the electric field. Due to the electric field, electron beams emitted from the emitters 115 that are respectively disposed at both sides of a first aperture 112*a* can be efficiently focused proceeding toward fluorescent layers 122.

Referring to FIG. 13B, a peak in current density is precisely located in a central portion of a pixel. Accordingly, as shown in FIG. 13C, the size of the spot of an electron beam arriving at a fluorescent layer 122 is much smaller in a case where a cavity 111*a* is formed in each cathode electrode 111 of the FED 100 according to the first embodiment of the present invention than in a case where no cavity 111*a* is formed in each cathode electrode 111 of the corresponding modified FED 100. In addition, current density is higher in a case where a cavity 111*a* is formed in each cathode electrode 111 of the FED 100 according to the first embodiment of the present invention than in a case where no cavity 111*a* is formed in each cathode electrode 111 of the corresponding modified FED 100 as well as the FEDs of FIGS. 1A, 1B, 2A and 2B. Therefore, by forming a cavity 111*a* in each cathode electrode 111 of an FED, it is possible to enhance the focusing characteristics of electron beams, increase current density, place a peak in the current density in a central portion of each pixel of the FED, and eventually improve the color purity and brightness of the FED.

Figure 14A:
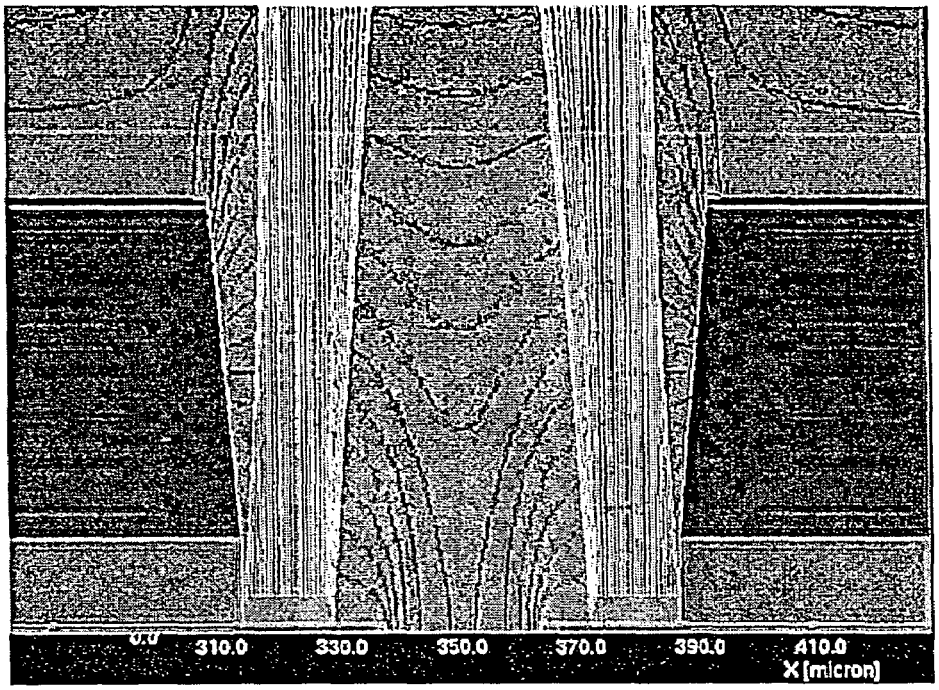
FIGS. 14A, 14B, and 14C are diagrams illustrating electron beam emission simulation results of the FED of FIG. 3 in a case where the width of the cavity formed in each cathode electrode of the corresponding FED has been changed.
Figure 14B:
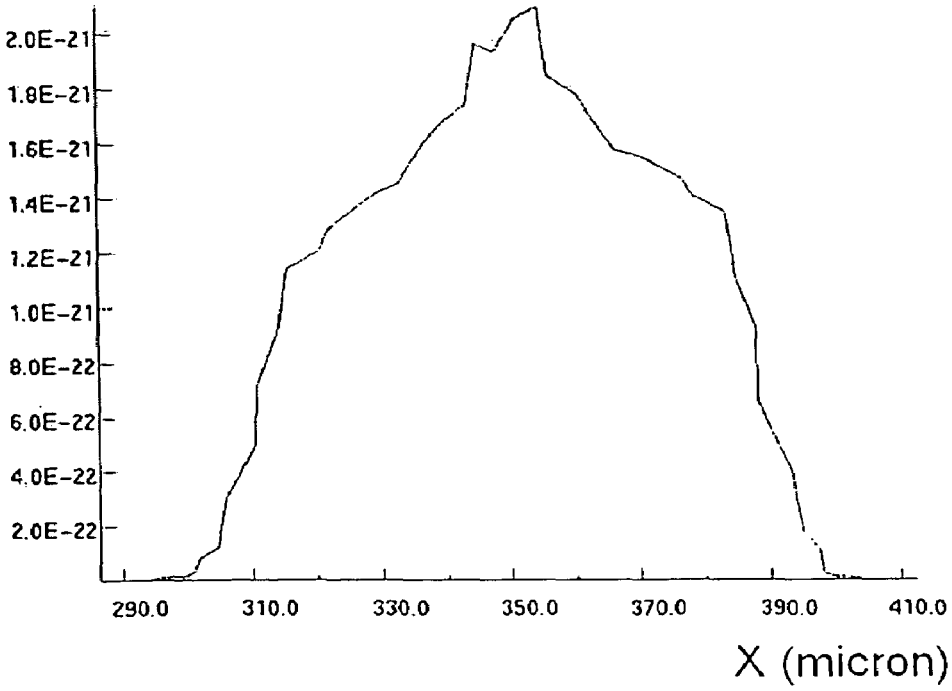
Figure 14C:
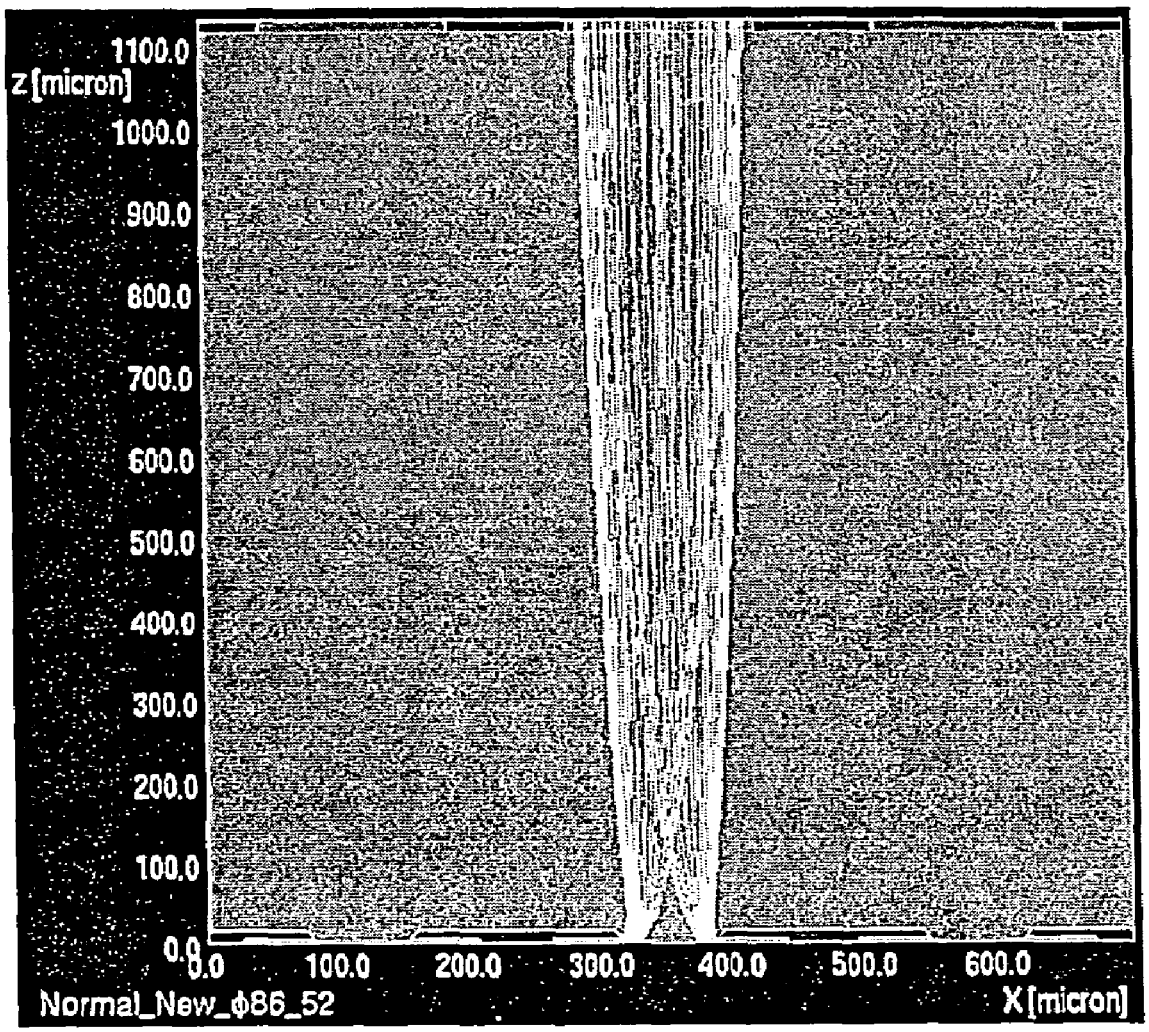

Turning now to FIGS. 14A, 14B and 14C, FIGS. 14A through 14C illustrate electron beam emission simulation empirical results of the FED 100 according to the first embodiment of the present invention, shown in FIG. 3, in a case where the width Wc of the cavity 111*a* formed in each cathode electrode 111 of the corresponding FED has been changed so that it is larger than the FEDs whose results are shown in FIGS. 13A, 13B and 13C.

Referring to FIG. 14A, an electric field is formed around the emitters 115 so that the emitters 115 can be better surrounded by equipotential lines of the electric field than in FIG. 12A. Referring to FIG. 14B, a peak in current density is precisely located in a central portion of a pixel. Accordingly, as shown in FIG. 14C, the size of the spot of an electron beam arriving at a fluorescent layer 122 is much smaller than in FIG. 13C. In addition, the current density is also much higher in FIG. 14C than in FIG. 13C. Therefore, by adjusting the width Wc of a cavity 111*a* formed in each cathode electrode 111 of FED 100, it is possible to considerably increase current density, efficiently focus electron beams, and eventually realize high quality images.

Figure 15A:
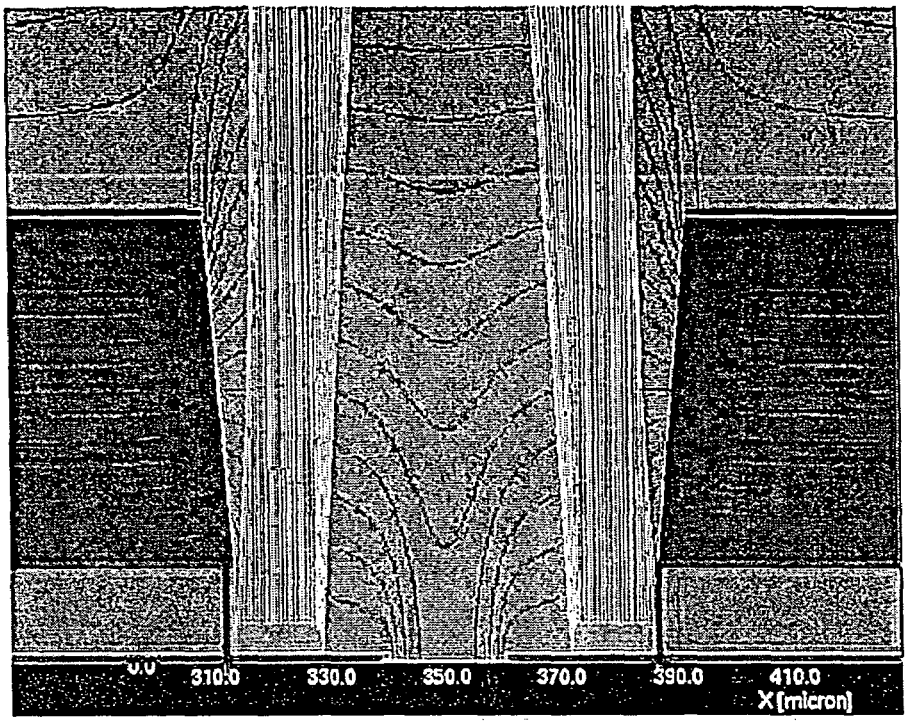
FIGS. 15A, 15B, and 15C are diagrams illustrating electron beam emission simulation results of the FED of FIG. 7.
Figure 15B:
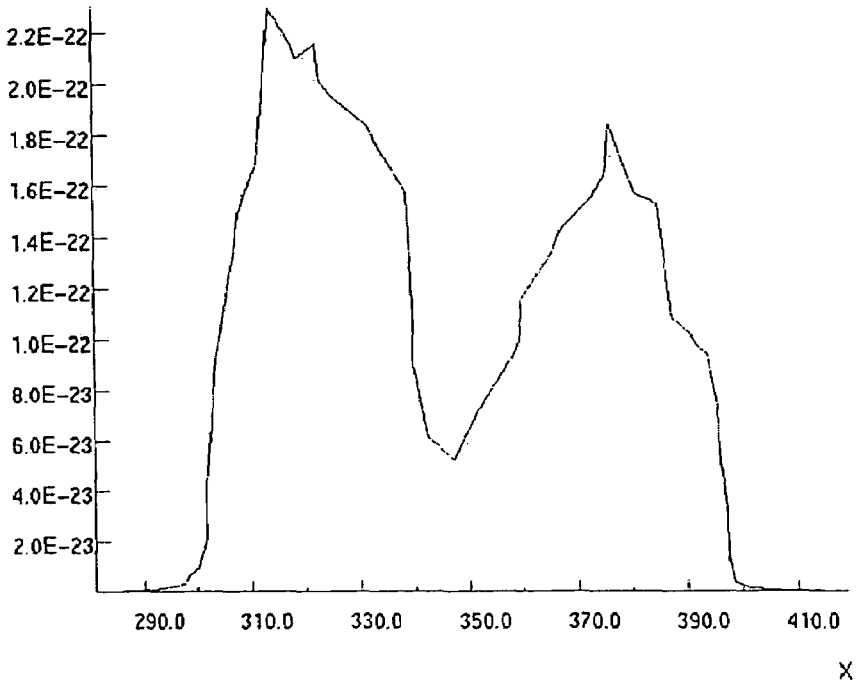
Figure 15C:
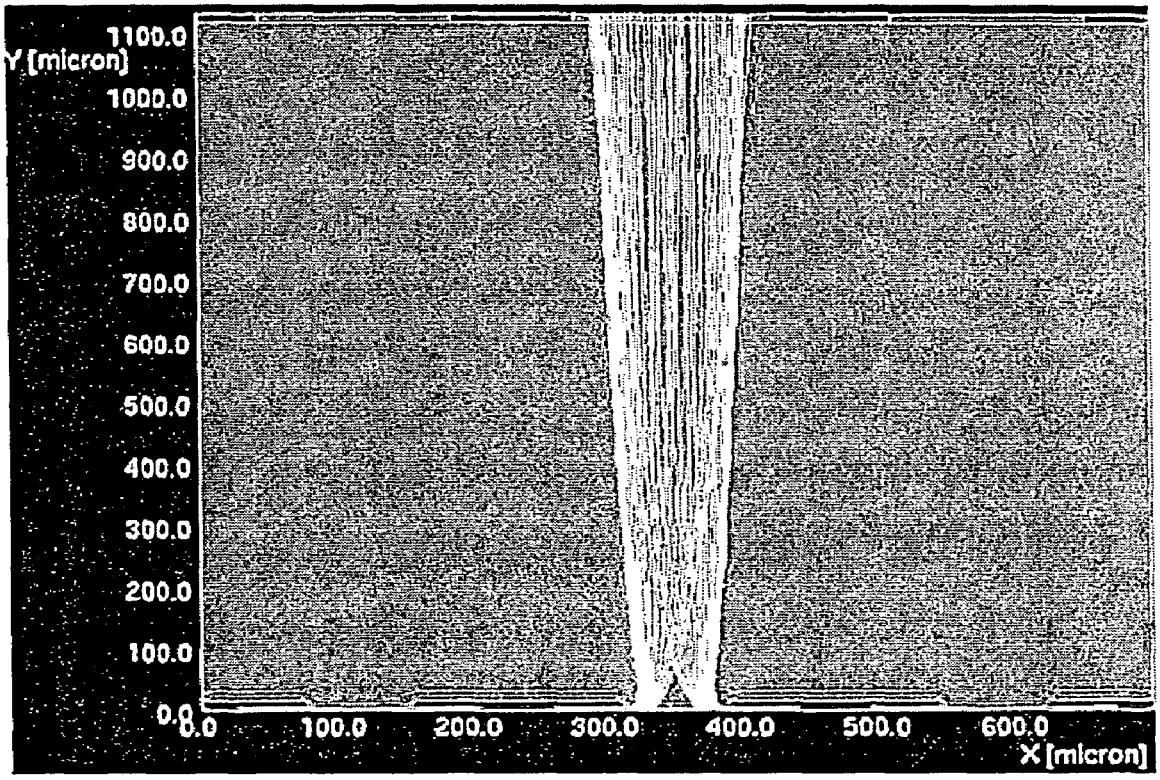

FIGS. 15A, 15B, and 15C are diagrams illustrating empirical results of electron beam emission simulation results of the FED 107 of FIG. 7. Referring to FIG. 15A, due to a conductive layer 112', which is formed of an insulation material layer 1121 and a metal layer 1122, and a cavity 111*a*, which is formed in a cathode electrode 111, an electric field is formed around emitters 115 so that the emitters 115 can be surrounded by equipotential lines of the electric field. Accordingly, electron beams emitted from the emitters 115 can be efficiently focused. Therefore, as shown in FIG. 15B, peaks in current density are precisely located in their respective pixels. In addition, as shown in FIG. 15C, the size of a spot of an electron beam on a fluorescent layer 122 is very small. As described above, the FED 107 of FIG. 7 can have the same effects as the FED 100 of FIG.

Figure 16A:
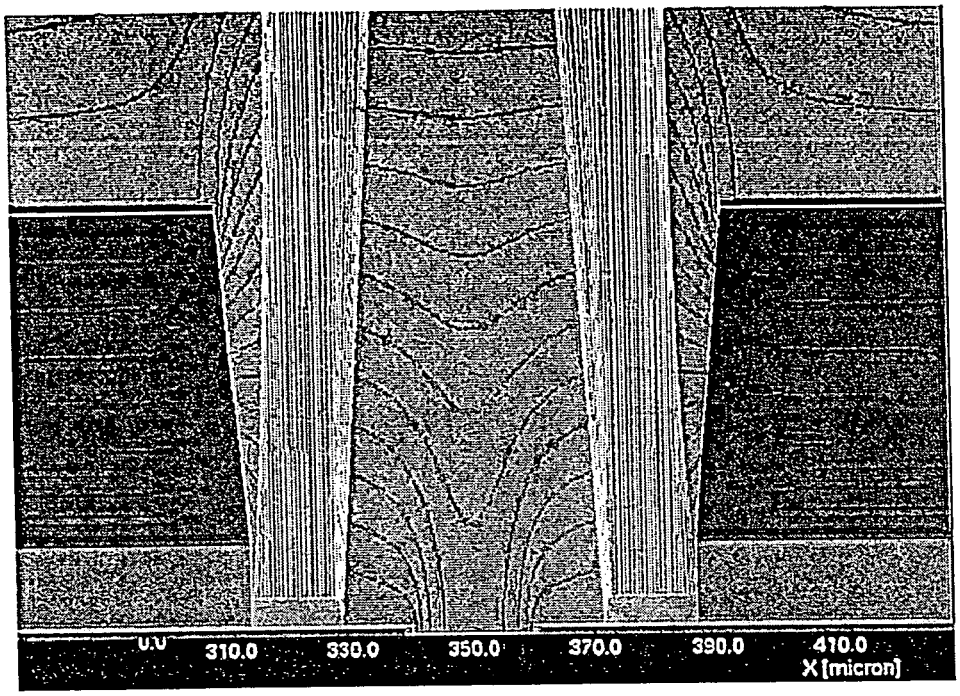
FIGS. 16A and 16B are diagrams illustrating electron beam emission simulation results of the FED of FIG. 8.
Figure 16B:
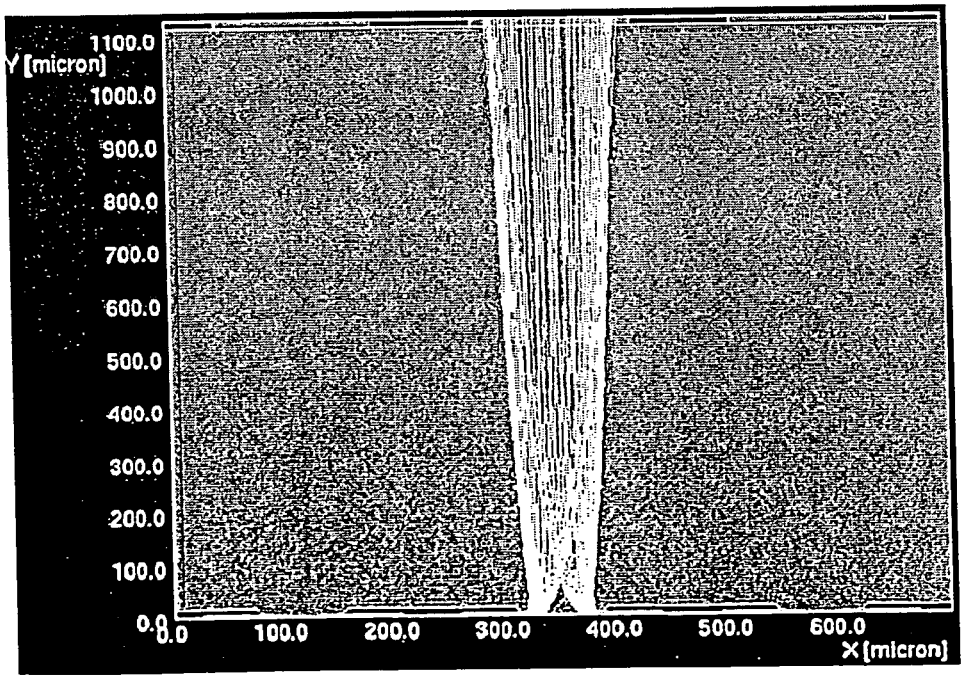

FIGS. 16A and 16B are diagrams illustrating electron beam emission simulation results of the FED 108 of FIG. 8. Referring to FIGS. 16A and 16B, the FED 108 of FIG. 8, in which a conductive layer 112" is formed on the top surface of an insulation material layer 1123 so that it can be insulated from a cathode electrode 111, has the same effects as the FEDs 100 and 107 of FIGS. 3 and 7. The FED 108 of FIG. 8 can focus electron beams more efficiently than the FEDs 100 and 107 of FIGS. 3 and 7 by adjusting a voltage applied to the conductive layer.

As described above, the FEDs according to the present invention can improve the focusing characteristics of electron beams emitted from emitters resulting in increased color purity of images and thus realize high quality images. In addition, the FED according to the present invention can improve the brightness of images by precisely placing a peak in current density in each pixel.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A field emission display (FED), comprising:

a first substrate;

a cathode electrode arranged on the first substrate, with a circular cavity being formed perforating the cathode electrode exposing the first substrate therethrough;

a first layer arrangement arranged on the cathode electrode and being perforated by a first circular aperture that exposes an exposed portion of the cathode electrode;

an insulation layer arranged on the first layer arrangement and being perforated by a second circular aperture that is adjacent to the first circular aperture;

a gate electrode arranged on the insulation layer and being perforated by a third circular aperture that is adjacent to the second circular aperture;

an emitter arranged in a ring shape on the exposed portion of the cathode electrode, the emitter being arranged along an inner circumference of the first circular aperture; and a second substrate arranged to face the first substrate with a predetermined distance therebetween, an anode electrode and a fluorescent layer having a predetermined pattern being arranged on the second substrate, wherein inner diameters of the third circular aperture and the second circular aperture are larger than an inner diameter of the first circular aperture, and an inner diameter of the cavity is smaller than the inner diameter of the first circular aperture.

2. The FED of claim 1, wherein an inner diameter of the emitter is smaller than the inner diameter of the first circular aperture, and the inner diameter of the cavity is smaller than the inner diameter of the emitter.

3. The FED of claim 2, wherein the inner diameter of the third circular aperture is the same as the inner diameter of the second circular aperture.

4. The FED of claim 2, wherein the inner diameter of the third circular aperture is larger than the inner diameter of the second circular aperture.

5. The FED of claim 1, wherein the first layer arrangement comprises;

an insulation material layer formed on a top surface of the cathode electrode; and a metal layer formed on a top surface and on side surfaces of the insulation material layer.

6. The FED of claim 1, wherein a plurality of first circular apertures, a plurality of second circular apertures, and a plurality of third circular apertures are formed for each pixel, and the emitter is formed in each of the plurality of first circular apertures.

7. The FED of claim 1, wherein the emitter comprises a carbon-based material.

8. The FED of claim 7, wherein the emitter comprises carbon nano-tubes.

9. The FED of claim 1, wherein an inner diameter of the circular cavity of the cathode electrode is smaller than an inner diameter of the emitter.

10. The FED of claim 1, the cathode having a smaller inner diameter than an inner diameter of the emitter.

11. The FED of claim 10, a center of the inner diameter of the cathode being concentric with a center of an inner diameter of the emitter.

12. A field emission display (FED), comprising:

a first substrate;

a cathode electrode arranged on the first substrate;

an insulation material layer arranged on the cathode electrode;

a conductive layer arranged on the insulation material layer;

a first circular aperture arranged to perforate through the insulation material layer and the conductive layer exposing an exposed portion of the cathode electrode;

an insulation layer arranged on the conductive layer and perforated by a second circular aperture that is directly over the first circular aperture;

a gate electrode arranged on the insulation layer and perforated by a third circular aperture that is directly over the second circular aperture;

an emitter arranged as a ring on the exposed portion of the cathode electrode, the emitter being disposed along an inner circumference of the first circular aperture; and a second substrate arranged to face the first substrate with a predetermined distance therebetween, an anode electrode and a fluorescent layer being arranged on the second substrate.

13. The FED of claim 12, wherein the conductive layer is electrically insulated from the cathode electrode by the insulation material layer.

14. The FED of claim 12, wherein the cathode electrode is perforated by a circular cavity exposing the first substrate therethrough, and the circular cavity is surrounded by the emitter.

15. The FED of claim 14, wherein inner diameters of the second and third circular apertures are larger than an inner diameter of the first circular aperture, and an inner diameter of the circular cavity is smaller than the inner diameter of the first circular aperture.

16. The FED of claim 15, wherein an inner diameter of the emitter is smaller than the inner diameter of the first circular aperture, and the inner diameter of the circular cavity is smaller than the inner diameter of the emitter.

17. The FED of claim 16, wherein the inner diameter of the third circular aperture is the same as the inner diameter of the second circular aperture.

18. The FED of claim 16, wherein the inner diameter of the third circular aperture is larger than the inner diameter of the second circular aperture.

19. The FED of claim 12, wherein a longitudinal end of the conductive layer is electrically connected to the cathode electrode.

20. The FED of claim 12, wherein a plurality of first circular apertures, a plurality of second circular apertures, and a plurality of third circular apertures are formed for each pixel, and the emitter is arranged in each of the plurality of first circular apertures.

21. The FED of claim 12, wherein the emitter is comprised of a carbon-based material.

22. The FED of claim 21, wherein the emitter is comprised of carbon nano-tubes.

23. The FED of claim 12, the conductive layer being a plated conductive layer.

* * * * *